US007521618B2

(12) United States Patent
Okuyama

(10) Patent No.: US 7,521,618 B2
(45) Date of Patent: Apr. 21, 2009

(54) TUNING DEVICE FOR MUSICAL INSTRUMENTS AND COMPUTER PROGRAM USED THEREIN

(75) Inventor: Fukutaro Okuyama, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 200 days.

(21) Appl. No.: 11/480,208

(22) Filed: Jun. 30, 2006

(65) Prior Publication Data

US 2007/0000369 A1 Jan. 4, 2007

(30) Foreign Application Priority Data

Jul. 4, 2005 (JP) ..... 2005-194792

(51) Int. Cl.
*G10G 7/02* (2006.01)

(52) U.S. Cl. ..... 84/454; 84/455; 84/723

(58) Field of Classification Search ..... None
See application file for complete search history.

(56) References Cited

U.S. PATENT DOCUMENTS 4,429,609 A 2/1984 Warrender
5,619,004 A 4/1997 Dame
5,973,252 A * 10/1999 Hildebrand ..... 84/603
7,049,502 B2 * 5/2006 Taku et al. ..... 84/454
7,268,286 B2 * 9/2007 Carpenter ..... 84/454

FOREIGN PATENT DOCUMENTS

EP 1335351 8/2003
JP 09-257558 10/1997

* cited by examiner

*Primary Examiner*—Marlon T Fletcher
(74) *Attorney, Agent, or Firm*—Harness, Dickey & Pierce, PLC

(57) ABSTRACT

A portable tuning device includes a microphone, a data processing system and a touch-panel liquid crystal display device, and assists a user in a tuning work on an upright piano; when the user depresses a key, sound waves, which expresses a tone, are propagated to the microphone, and are converted to an audio signal, the waveform of which is converted to audio data codes; the data processing system firstly calculates an introductory autocorrelation on the audio data codes for a small number of delayed waveform so as to determine a register to which the tone belongs, and, thereafter, calculates a principal autocorrelation on the audio data codes for delayed waveforms within the register so as to estimate the pitch of the tone; since the compass is narrowed to the register through the introductory autocorrelation, the amount of calculation is relatively small in the principal autocorrelation.

20 Claims, 12 Drawing Sheets

| m | msec |
|---|---|
| 1st | 6 |
| 2nd | 12 |
| 3rd | 25 |
| 4th | 50 |

TUNING DEVICE FOR MUSICAL INSTRUMENTS AND COMPUTER PROGRAM USED THEREIN

FIELD OF THE INVENTION

This invention relates to a tuning device for musical instruments and, more particularly, to a tuning device for judging the pitch of tones in a tuning work on musical instruments and a computer program used therein.

DESCRIPTION OF THE RELATED ART

The tuning device is designed to assist a user in a tuning work on a musical instrument. While the user producing tones in the musical instrument, the tuning device analyzes the sound waves for the pitch name, octave and difference from a target pitch, i.e., current tuning status of the musical instrument, and notifies the user of the current tuning status through visual images.

A typical example of the prior art tuning device is disclosed in Japanese Patent Publication No. Hei 3-42412. The prior art method disclosed in the Japanese Patent Publication is hereinafter briefly described. While the sound waves are being supplied from a musical instrument to the prior art tuning device, the tuning device converts the sound waves to an audio input signal, and produces a pulse train from the audio input signal. While the audio input signal is keeping the potential level over zero, the prior art tuning device also keeps the pulse at the high level. The pulse is decayed to the low level at the decay of the audio input signal under zero. If the audio input signal keeps the potential level over zero for a long time, the corresponding pulse has a long pulse width. On the other hand, if the audio input signal raises the potential level over zero for a short time, the corresponding pulse shrinks the pulse width. For this reason, the irregular pulses form the pulse train, and the pulse width is variable.

The prior art tuning device introduces a delay time, which is equal to the time period from the first pulse rise over zero to the next pulse rise over zero, into the original pulse train, and produces the first delayed pulse train. A delay time, which is equal to the time period from the second pulse rise over zero to the third pulse rise over zero, is further introduced into the first delayed pulse train, and produces the second delayed pulse train. In this manner, the delay times, which are respectively equal to the pulse intervals of the original pulse train after the second pulse period, are successively introduced into the delayed pulse trains.

Subsequently, the prior art tuning device checks the delayed pulse trains for the correlation with the original pulse train. If the total amount of delay time is equal to the major repetition period of the audio input signal which strongly relates to the pitch of the tone, the correlation with the original pulse train is found to be high. On the other hand, if the total amount of delay time is different from the major repetition period of the audio input signal, the delayed pulse train has a low value of the correlation with the original pulse train. Thus, the pitch of tone on the sound waves is determinable through the correlation analysis on the delayed pulse trains in spite of undesirable influences of short repetition periods on the audio input signal. The prior art tuning device disclosed in the Japanese Patent Publication is hereinafter referred to as "the first prior art tuning device".

Another prior art tuning device, which is an improvement of the prior art tuning device disclosed in the Japanese Patent Publication, is disclosed in Japanese Patent Application laid-open No. Hei 9-257558. The prior art tuning device disclosed in the Japanese Patent Application laid-open compares the audio input signal with a threshold, which makes it possible to discriminate high-level peaks in the audio input signal, and another threshold, which makes it possible to discriminate low-level peaks in the audio input signal, and determines the high-level peaks and low-level peaks. The original pulse train is further produced from the audio input signal, and the delayed pulse trains are also produced from the original pulse train. The prior art tuning device determines the correlation between the original pulse train and each of the delayed pulse trains at the peaks, and further determines the pitch of tone on the basis of the total amount of delay time. The prior art tuning device disclosed in the Japanese Patent Application laid-open is hereinafter referred to as "the second prior art tuning device".

Yet another tuning method is further described in the Japanese Patent Application laid-open, and is hereinafter referred to as "the third prior art tuning device". Time delays are successively introduced into the audio input signal, and the third prior art tuning device determines the correlation between the delayed audio input signals and the audio input signal in the entirety of the waveforms.

A problem is encountered in the first prior art tuning device and second prior art tuning device in that the accuracy of the correlation is liable to be damaged with noises around the zero-crossing points and strong harmonic. A noise component is assumed to rapidly raise the potential level of the audio input signal over zero immediately before the pulse raise for the major repetition period. The noise makes the major repetition period longer than usual. As a result, the correlation is lowered. A strong harmonic also makes the major repetition period vague. An extremely large number of zero-cross points take place in the original pulse train, and each of the zero-cross points has a possibility of the strong correlation. For this reason, the first and second prior art tuning devices determine an extremely large number of delayed pulse trains at all the zero-crossing points, and have to carry out a huge amount of calculation for the correlation at all the zero-crossing points. As a result, the values of correlation at certain zero-crossing points are close to one another, and the influence of noise becomes serious.

A problem inherent in the third prior art tuning device is the large amount of calculation for the correlation. If a musical instrument is to be tuned at a large number of target pitches, a long time period is required for the tuning work so that the third prior art tuning device is less feasible.

SUMMARY OF THE INVENTION

It is therefore an important object of the present invention to provide a tuning device, which accurately determines an actual pitch of a tone without a large mount of calculation.

It is also an important object of the present invention to provide a computer program, which is loaded in the tuning device.

The present inventor contemplated the problem inherent in the prior art, and noticed that there were plural possibilities equal to the number of keys of a piano for each tone to be analyzed. Pianos typically had eighty-eight keys so that there were eighty-eight possibilities for each tone to be analyzed. In this situation, the autocorrelation was to be eighty-eighth times repeated for eighty-eight values of delay, which were equivalent to the eighty-eight repetition periods of the waveforms respectively expressing the eighty-eight piano tones. A large amount of calculation was required for the estimation on each piano tone.

The present inventor concentrated his effort how to reduce the amount of calculation. The present inventor noticed that the autocorrelation was to be focused on candidates in a register in which the tone to be analyzed was possibly found.

To accomplish the object, the present invention proposes stepwise to narrow down a frequency range of a waveform representing a tone through a multiple-step autocorrelation or repetition of autocorrelation.

In accordance with one aspect of the present invention, there is provided a tuning device for assisting a user in a tuning work on a musical instrument comprising a converter converting vibrations representative of a tone produced in the musical instrument to an electric signal representative of the vibrations, a data processing system connected to the converter, and carrying out a multiple-step autocorrelation on a waveform of the electric signal so as stepwise to narrow down a frequency range featuring the tone, and a man-machine interface connected to the data processing system, and visualizing a result of the multiple-step autocorrelation.

In accordance with another aspect of the present invention, there is provided a computer program expressing a method for assisting a tuning work on a musical instrument, and the method comprises the steps of a) converting vibrations representative of a tone produced in the musical instrument to an electric signal representative of the vibrations, b) accumulating pieces of data information representative of a waveform of the electric signal in a data storage, c) narrowing down a frequency range of the waveform featuring the tone through repetition of autocorrelation on the pieces of data information and d) visualizing a narrowed frequency range.

BRIEF DESCRIPTION OF THE DRAWINGS

The features and advantages of the tuning device and computer program will be more clearly understood from the following description taken in conjunction with the accompanying drawings, in which.

DESCRIPTION OF THE PREFERRED EMBODIMENTS

A tuning device embodying the present invention is used in a tuning work on a musical instrument. In other words, the user tunes the musical instrument with the assistance of the portable tuning device.

The tuning device comprises a converter, a data processing system connected to the converter and a man-machine interface connected to the data processing unit. When a tone is produced in the musical instrument, vibrations, which are representative of the tone, are input to the converter, and the converter converts the vibrations to an electric signal representative of said vibrations. Pieces of data information expressing the tone form a waveform of electric signal, and the electric signal is supplied to the data processing unit.

The data processing system carries out a multiple-step autocorrelation on the waveform of the electric signal, and analyzes frequency characteristics of the electric signal such as a periodicity of certain frequency components through the multiple-step autocorrelation. At least two sorts of autocorrelations are incorporated in the multiple-step autocorrelation. A relatively wide frequency range, which is strongly correlated with the waveform, is firstly determined through one of the at least two sorts of autocorrelations, and the frequency range is narrowed down through the other sort or sorts of autocorrelations carried out in the relatively wide frequency range. The narrowed frequency range precisely expresses the frequency characteristics of the electric signal and, accordingly, the tone. The load on the data processing system for the other sort or sorts of autocorrelations is light, because the relatively wide frequency range is narrower than the whole frequency range is. Thus, the reduction in load makes the feature of tone clear.

First Embodiment

Figure 1:
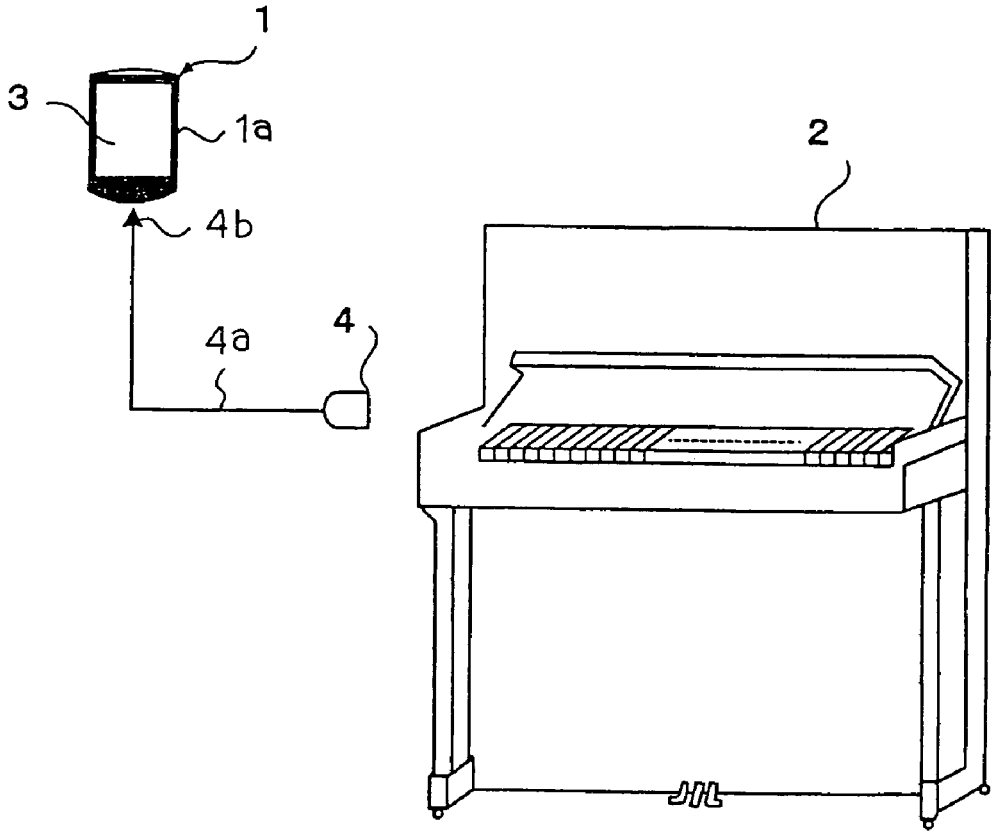
FIG. 1 is a schematic view showing the external appearance of a portable tuning device according to the present invention.

Referring to FIG. 1 of the drawings, a portable tuning device 1 embodying the present invention is designed to assist a user in a tuning work on an upright piano 2, and is provided as a PDA (Personal Digital Assistants).

The portable tuning device 1 comprises a housing 1*a*, a data processing system 1*b*, which will be hereinlater described with reference to FIG. 2, a touch-panel display device 3 and a microphone 4. The data processing system 1*b* is provided inside the housing 1*a*, and the touch-panel display device 3 is set in the housing 1*a*. The microphone 4 is connected to a connecting cable 4*a*, and a plug 4*b*, which is provided on the other end of the connecting cable 4*a*, is inserted in a jack (not shown) on the housing 1*a*.

A user directs the microphone 4 to the upright piano 2, and depresses one of the black and white keys. The key motion gives rise to vibrations of the associated string, and sound waves, which express a tone, are propagated to the microphone 4. The portable tuning device 1 accomplishes at least two tasks, i.e., determines the pitch name of a tone, and visualizes the phase difference between the target pitch and the actual pitch of the tone.

The data processing system 1*b* is connected to the touch-panel display device 3, and is further connected to the microphone 4 through the jack (not shown) and connecting cable 4*a*. The touch-panel display device 3 serves as a man-machine interface so that users are communicable with the data processing system 1*b* through the touch-panel display device 3. In this instance, a liquid crystal display panel and a transparent conductive film form in combination the touch-panel display device 3. The tones are converted to an analog audio signal through the microphone 4, and the audio signal is supplied to the data processing system 1*b*.

Figure 2:
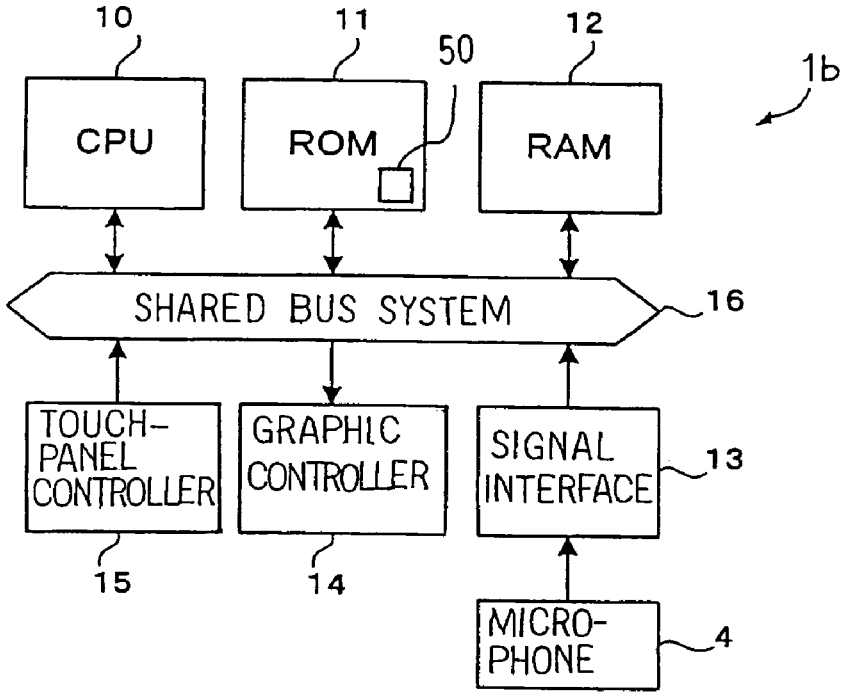
FIG. 2 is a block diagram showing the system configuration of an electronic system incorporated in the portable tuning device.

As shown in FIG. 2, the data processing system 1*b* includes a central processing unit 10, which is abbreviated as "CPU", a read only memory 11, which is abbreviated as "ROM", a random access memory 12, which is abbreviated as "RAM", a signal interface 13, a graphic controller 14, a touch-panel controller 15 and a shared bus system 16. The central processing unit 10, read only memory 11, random access memory 12, signal interface 13, graphic controller 14 and touch-panel controller 15 are connected to the shared bus system 16 so that the central processing unit 10 is communicable with those system components 11, 12, 13, 14 and 15. The central processing unit 10, read only memory 11, random access memory 12 and a part of the shared bus system 16 may be integrated on a monolithic semiconductor chip as a microcomputer.

A computer program is stored in the read only memory 11, and the instruction codes, which form the computer program, are sequentially read out from the read only memory 11 to the shared bus system 16. The instruction codes thus read out onto the shared bus system 16 are fetched by the central processing unit 10, and are executed for accomplishing a given task. The computer program includes a main routine program and subroutine programs.

The central processing unit 10 is an origin of the data processing capability, and achieves jobs through the execution of the instruction codes. When a user supplies electric power to the data processing system 1*b*, the main routine program starts to run on the central processing unit 10. The central processing unit 10 firstly initializes the data processing system 1*b*, and waits for a user's instruction. Several jobs in the main routine program will be hereinlater described.

One of the subroutine programs is assigned to visualization of the difference between the actual frequency of a tone and the target frequency of the tone. When a user instructs the data processing system 1*b* to assist him or her in the tuning work on the upright piano 2, the main routine program starts to run on the central processing unit 10, and periodically branches to the subroutine program for the visualization. Another of the subroutine programs is assigned to estimation of the pitch name of a tone produced in the musical instrument, and the main routine program periodically branches to the subroutine program for the estimation of the pitch name. In this instance, the portable tuning device 1 estimates the actual pitch through a two-step autocorrelation. The autocorrelation makes it possible to estimate the periodicity of an input periodic signal.

The random access memory 12 offers a working area to the central processing unit 10. A digital audio signal or a series of audio data codes is accumulated in the random access memory 12 in the tuning work, and the central processing unit 10 examines the series of audio data codes to see how many frequencies the analog audio signal is assumed to have and whether or not a tone, which is expressed by the series of audio data codes, has an actual pitch equal to a target pitch.

The signal interface 13 has an amplifier and an analog-to-digital converter, and the analog audio signal is supplied from the microphone 4 to the amplifier. The analog audio signal is amplified through the amplifier, and is supplied to the analog-to-digital converter after the amplification. The analog audio signal is sampled at regular time intervals, and the discrete values on the analog audio signal are converted to the audio data codes. The pieces of audio data are relayed from the analog audio signal to the series of audio data codes. In this instance, the sampling frequency is adjusted to 44.1 kilohertz. The central processing unit 10 periodically fetches the audio data codes from the signal interface 13, and accumulates the audio data codes in the random access memory 12.

The graphic controller 14 is connected to the liquid crystal display panel of the touch-panel display device 3. The graphic controller 14 produces visual images on the liquid crystal display panel under the control of the central processing unit 10. Visual images form pictures, and each picture appears on the liquid crystal display panel over a frame or frames. The images of the pictures will be hereinlater described in detail. The picture is changed to a new picture or maintained in the next frame. Standard personal digital assistants usually repeat the frames at 15 Hz to 20 Hz. The frame frequency is less than the pitch of the lowest tone produced through the upright piano 2.

The touch-panel controller 15 is connected to the transparent conductive film of the touch-panel display device 3, and cooperates with the graphic controller 14. The touch-panel controller 15 provides a coordinate on the visual images produced on the liquid crystal display panel. When a user pushes a part of the transparent conductive film overlapped with a visual image with a suitable tool such as, for example, a pen, the touch-panel controller 15 determines the visual image on the liquid crystal display panel. In case where the visual images express some instructions, the central processing unit 10 recognizes the user's instruction through the image or images specified by the touch-panel controller 15.

Figure 3A:
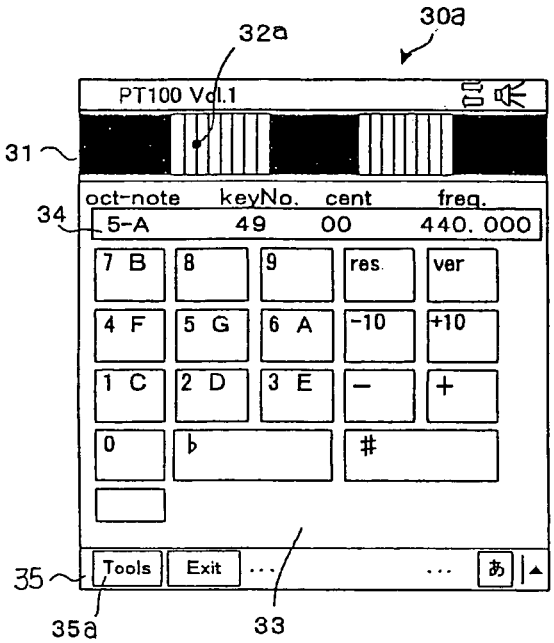
FIGS. 3A and 3B are front views showing visual images produced on a touch-panel liquid crystal display device of the portable tuning device.
Figure 3B:
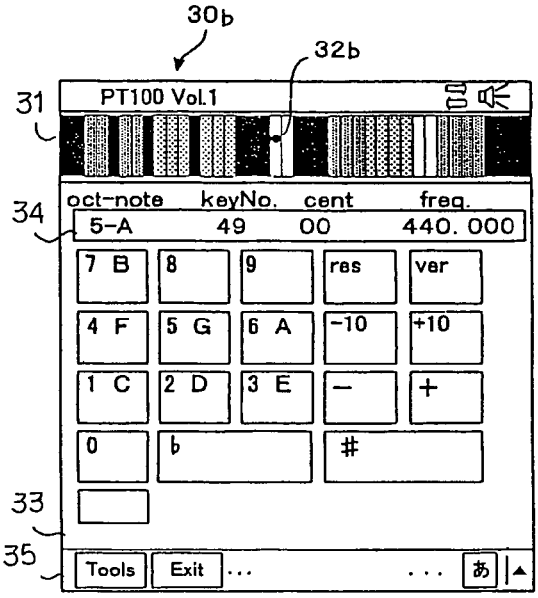

FIGS. 3A and 3B show different pictures 30*a* and 30*b* produced on the touch-panel display device 3. The pictures 30*a* and 30*b* have at least four areas 31, 33, 34 and 35. The area 31 is assigned to gradation images 32*a*, 32*b*, . . . , which express the degree of phase difference between the actual waveform of the analog audio signal and the target waveform. The target waveform is representative of a target pitch or target frequency to which the musical instrument is to be tuned. An actual signal period or an actual repetition period is determined on the basis of the actual waveform, and the repetition period is the inverse of an actual frequency.

Although the gradation image 32*a* is produced from two tones, at least three tones or shades, i.e., lighter, darker and intermediate shades form the gradation image 32*b*. The gradation image 32*a*, which is produced from the two tones, expresses the consistency in phase between the actual waveform of audio signal and the target waveform. On the other hand, when a certain degree of phase difference takes place between the actual waveform of audio signal and the target waveform, the gradation image 32*b*, which is formed by more than two tones, appears in the area 31. If the phase difference is different from that expressed by the gradation image 32*b*, another gradation image, which is also produced from more than two tones, is produced on the touch-panel display device 3 as will be hereinlater described in detail.

The areas 33 and 35 are assigned to images of button switches. "7B", "8", "9", "res", "ver", "4F", "5G", "6A", "−10", "+10", "1C", "2D", "3E", "−", "+", "0", "b" and "#" are enclosed with rectangles, which express the peripheries of the button switches. The button switches "7B", "4F", "5G", "6A", "1C", "2D" and "3E" are shared between the numerals "7", "4", "5", "6", "1", "2" and "3" and the alphabets "B", "F", "G", "A", "C", "D" and "E". The alphabets express pitch names. Users specify a pitch name and an octave by pressing the button switches with the tool. When a user pushes the image of button switch "Tools", a job list is displayed on the entire area instead of the images shown in FIGS. 3A and 3B.

The area 34 is assigned to pieces of tuning information. Abbreviations "oct-note", "keyNo.", "cent" and "freq" are labeled with four sub-areas in the rectangle. The abbreviations "oct-note", "keyNo.", "cent" and "freq." and visual images produced below the abbreviations are hereinafter described in detail.

The visual images below the abbreviation "oct-note" express a pitch name assigned the tone to be targeted and an octave where the tone belongs. The visual image "5-A" means that the tone to be targeted is A in the fifth octave. The central processing unit 10 determines the pitch name and octave through execution of a subroutine program, and informs the user of the pitch name and octave through the visual images in the sub-areas below the abbreviation "oct-note".

The visual image below the abbreviation "keyNo." expresses the key number assigned the key at "5-A". The upright piano 2 has eighty-eight black and white keys, and the key numbers "1" to "88" are assigned to the eighty-eight black and white keys. The pitch name A in the fifth octaves is assigned to the key with the key number "49".

The visual image below the abbreviation "cent" expresses the interval between two tones. As well know to the persons skilled in the art, a whole tone in the temperament is equivalent to 200 cents, and, accordingly, the semitone is equivalent to 100 cents. When a user wishes to specify a tone offset from the tone "5-A" by a quarter tone, he or she inputs "50" cents through the visual images of button switches. When the visual images of "00" is produced in the sub-area below "cent" as those in FIGS. 3A and 3B, the tone is to be found just at A in the fifth octave.

The visual images below the abbreviation "freq." express the target frequency corresponding to the target pitch to which the musical instrument is to be tuned during data input by a user. A frequency, which is corresponding to the designated pitch name, is to be modified with the interval "cent" for the target pitch "freq.". In FIGS. 3A and 3B, numeral images "440.00" is read in the sub-area under the abbreviation "freq" together with the pitch name "5-A" and interval "00". This means that the tone "A" in the fifth octave, which is produced through the musical instrument 2, is to be found at 440.00 hertz. Though not shown in the drawings, while the portable tuning device 1 is assisting the user in the tuning work on the upright piano 2, the portable tuning device 1 can estimate the target frequency of a tone produced in the upright piano 2 without user's designation, and produces a visual image of the target frequency.

At the beginning of the tuning work, a user may specify a value of the target pitch through the data input for the standard pitch, pitch name, octave and interval through the manipulation on the images of button switches. As described hereinlater in detail, the portable tuning device 1 can estimate the tone at a certain pitch. In case where the portable tuning device 1 determines the pitch name on the basis of the estimated pitch, the user inputs only the standard pitch and interval.

In both cases, the central processing unit 10 causes the graphic controller 14 to produce the visual images expressing the pitch name, octave and interval in cent below the abbreviations "oct-note" and "cent". The central processing unit 10 determines the key number on the basis of the pitch name and octave, and further determines the fundamental frequency on the basis of the pitch name, octave and interval. The fundamental frequency features the tone assigned the target pitch name, and serves as the target pitch in this instance.

In order quickly to determine the key number and frequency, the pitch names in several octaves, key number assigned to the black and white keys of a standard piano and values of fundamental frequency are correlated with one another for several values of the standard pitch in the read only memory 11. When a user inputs a value of the standard pitch, a pitch name and an octave through the touch-panel liquid crystal display device 3, the central processing unit 10 determines the pitch name in the given octave on the basis of the coordinates reported from the touch-panel controller 15, and accesses a table, which is assigned to the designated standard pitch, in the read only memory 11 with the pitch name in the given octave. Then, the fundamental frequency and key number are read out from the read only memory 12 to the central processing unit 10. The central processing unit 10 supplies pieces of visual data expressing the pitch name, octave, key number and target frequency to the graphic controller 14, and the visual images are produced in the area 34 under the control of the graphic controller 14.

If the user further inputs the interval from the tone assigned the pitch name, the visual image of which is presently produced in the area 34, the touch-panel controller 15 reports the coordinate of the visual image of button switch pushed by the user to the central processing unit 10, and the central processing unit 10 converts the interval from the cent to the hertz. The central processing unit 10 adds the interval expressed in hertz to the fundamental frequency, and supplies the pieces of visual data expressing the new fundamental frequency to the graphic controller 14. The visual image of interval in cent and visual image of new fundamental frequency are produced in the area 34 under the control of the graphic controller 14.

While the sound waves are being propagated from the upright piano 2 to the portable tuning device 1, the portable tuning device 1 analyzes the analog audio signal for the phase difference between the actual frequency and the target frequency, and visualizes the phase difference on the touch-panel liquid crystal display device 3. If a user instructs the portable tuning device to determine the pitch name, the portable tuning device 1 estimates the actual frequency of the tone through two-step autocorrelation, and determines the target frequency of the tone. Thus, the portable tuning device 1 can inform the user of the target pitch name together with the phase difference through the visual images. Thus, the portable tuning device 1 according to the present invention assists the user in the tuning work through the visual images of the phase difference and the visual image of the target pitch name.

The portable tuning device 1 according to the present invention has two modes of operation, i.e., a manual mode and an automatic mode. When a user designates the target pitch name, the portable tuning device 1 enters the manual mode, and visualizes the phase difference between the actual frequency and the target frequency through a gradation image or images. On the other hand, when a user specifies the standard pitch and interval without any designation of pitch name, the portable tuning device 1 enters the automatic mode. The portable tuning device 1 determines the target pitch name and phase difference in the automatic mode, and visualizes them. Thus, the main routine program and subroutine program for visualization of phase difference are common to both manual and automatic modes. For this reason, description is firstly made on the main routine program and subroutine program for visualization of phase difference, and the subroutine program for estimation of target pitch is described after the description on the main routine program and subroutine program for the determination of phase difference.

While the main routine program is running on the central processing unit 10, the user inputs the standard pitch, pitch name "oct-note", interval "cent" and size of window W. The main routine program periodically branches to a subroutine program for visualizing the phase difference. The main routine program and two subroutine programs will be hereinlater described in detail.

Figure 4:
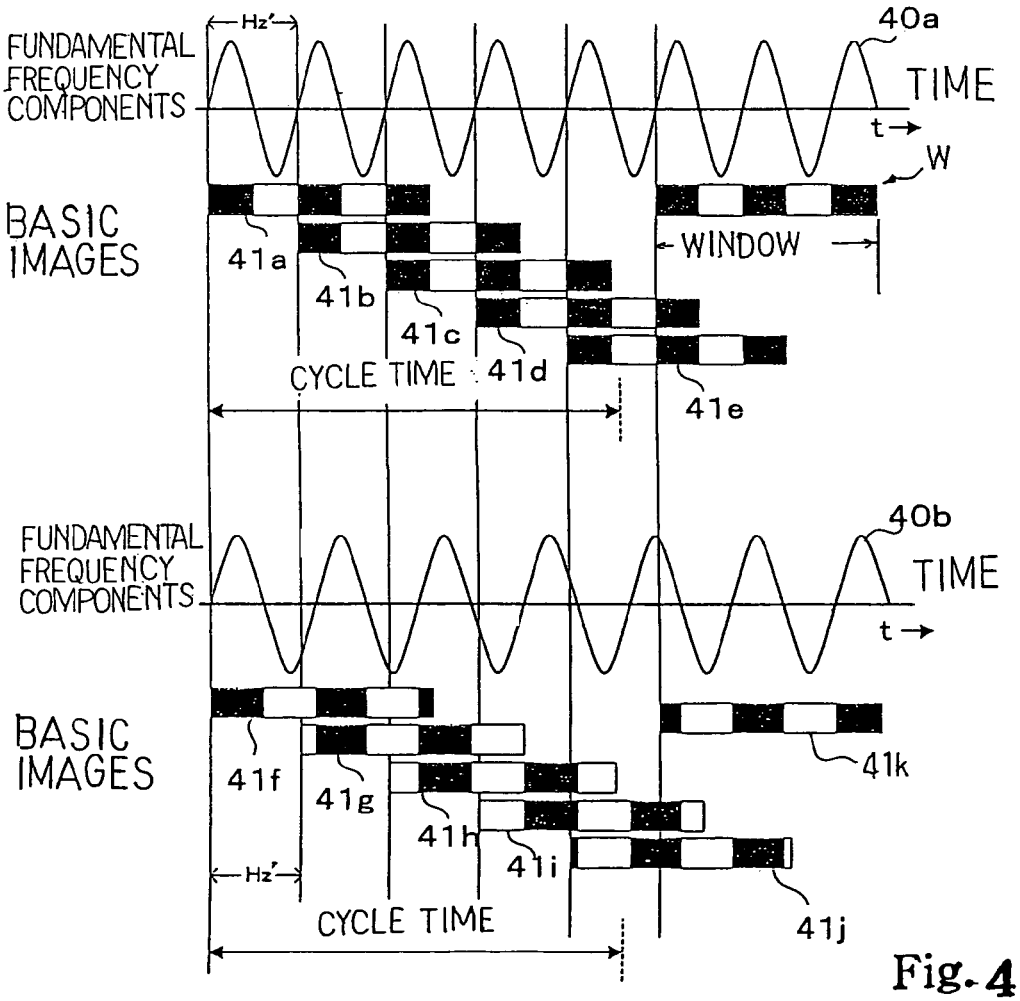
FIG. 4 is a graph showing relation of fundamental frequency components of electric signals representative of sound waves of tones and basic images.

The subroutine program for visualization of phase difference expresses a method for producing the gradation image 32*a* and 32*b* so that the method is illustrated in reference to FIG. 4. One of the particular features of the method is directed to superimposition of basic images. The term "superimposition" expresses an act to register objects with one another. The gradation image 32*a*/32*b*, which expresses the degree of phase difference between each single actual waveform of the audio signal and a single target waveform at a target pitch, is produced from the basic images through the superimposition.

Some terms are hereinafter defined for the method according to the present invention. A "cycle time" is equivalent to the time period expressed by the gradation image. A "window" is a time period equal to a product between the inverse of a target frequency Hz and an arbitrary number, and is shorter than the cycle time. Users set a window to a designated size for the resolution of the gradation image as will be described hereinlater in detail. The inverse of target frequency Hz is labeled with "Hz'" in FIG. 4, and the window is two and half times longer than the inverse Hz' of target frequency in the graph shown in the figure.

A "basic image" expresses the actual waveform of fundamental frequency component of the audio signal appearing in each window, and a "polarity pattern" repeatedly takes place in the window. The fundamental frequency component expresses the actual frequency of the tone. The polarity pattern expresses a pair of negative potential region and positive potential region. A part of the polarity pattern, which expresses the negative potential region, and the remaining part of the polarity pattern, which expresses the positive potential region, are referred to as a "negative portion" and a "positive portion", respectively. When the fundamental frequency component of the audio signal changes the potential level from the negative to the positive, the polarity pattern starts. The positive portion continues through the rise of the audio signal and the decay of the audio signal, and is terminated at the potential change from the positive to the negative. On the other hand, when the fundamental frequency component of audio signal is changed to negative, the negative portion starts, and is continued until the potential change to the positive, again.

The portable tuning device 1 firstly samples discrete values on the audio signal, and accumulates the discrete values in the random access memory 12 as the pieces of audio data. Subsequently, the fundamental frequency component or actual frequency is extracted from the discrete values, and pieces of fundamental frequency data, which express the fundamental frequency component or actual frequency, are accumulated in the random access memory 12. Plural series of pieces of fundamental frequency data are extracted from the accumulated pieces of fundamental frequency data for plural windows. Each of the plural series of fundamental frequency data occupies one of the windows. The piece of fundamental frequency data at the head of a series is delayed from the piece of fundamental frequency data at the head of the previous set by the inverse Hz'. Thus, the delay time, which is equal to the inverse Hz' of target frequency, is introduced between each series of pieces of fundamental frequency data and the next series of pieces of fundamental frequency data.

The plural series of fundamental frequency data are converted to plural series of polarity data, respectively. The pieces of polarity data express the positive potential region and negative potential region of the fundamental frequency component, and are stored in the random access memory 12. Each series of polarity data expresses the basic image. Since the delay time is introduced between a series of pieces of fundamental frequency data and the next series of pieces of fundamental frequency data, each basic image is also delayed from the previous basic image by the time period equal to the inverse Hz' of target frequency, and is partially overlapped with the previous basic image.

Subsequently, the basic images or plural series of pieces of polarity data are registered with or superimposed onto one another. Although the polarity pattern occupies the time period equal to the repetition period of the actual frequency of audio signal inverse Hz', the delay time between the basic images is equal to the inverse Hz' of the target frequency. For this reason, the difference in phase between the actual frequency and the target frequency has an influence on the basic images. When the basic images are superimposed onto one another, each negative pattern and each positive pattern are exactly superimposed on the other negative patterns and the other positive patterns in so far as the signal period or repetition period of the actual frequency of audio signal is equal to the inverse Hz' of target frequency. If the signal period or repetition period is shorter than or longer than the inverse Hz' of target frequency is, the boundary between the negative portion and the positive portion of each basic image is offset from the boundary between the negative portion and the positive portion of the next basic image, and the amount of offset between the adjacent basic images is increased from the first boundary to the last boundary in each cycle time. When the portable tuning device 1 proceeds to the next cycle time, the basic images of the gradation image are changed from those in the present cycle time. As a result, the gradation image looks as if it is slightly moved. While the portable tuning device 1 is repeating the renewal of the gradation image from the cycle time to the next cycle time the user feels as if the gradation image flows from one side toward the other side in the area 31.

Users set the window for the resolution. The shorter the window is, the higher the resolution is. The superimposed basic images, i.e., the gradation image 31*a*/31*b* occupy the whole area 31. In order to produce the gradation image in the whole area 31, the portable tuning device 1 properly magnifies the gradation images, and the magnification ratio is varied depending upon the length of the window or size of window W.

When a user instructs the portable tuning device 1 to elongate the window, many basic images occupy the window so that the portable tuning device magnifies each basic image at relatively small magnification ratio, because the many basic images are adjusted to the constant length of the area 31. On the other hand, when the user instructs the portable tuning device to shorten the window, a few basic images occupies the window so that the portable tuning device magnifies each basic image at relatively large magnification ratio so as to make the gradation image 31*a*/31*b* occupy the whole area 31. Since the basic images are magnified, the amount of offset is also magnified, and the user can discriminate an extremely small amount of offset through the gradation image. Thus, a short window makes the difference in phase between the repetition period of the audio signal and the inverse Hz' of target frequency clearly visualized.

Assuming now that a user inputs pitch name of "A" in the fifth octave by selectively pushing the images of button switches in the area 33, the central processing unit 10 acknowledges the manual mode, and determines that the target pitch is 440.00 hertz. The user is assumed not to input the offset or interval from the target pitch. The central processing unit 10 requests the graphic controller 14 to produce the visual images "5-A", "49", "00" and "440.00" in the area 34 as shown in FIGS. 3A and 3B.

When the user depresses the key assigned the key number of 49, the piano tone is produced inside the upright piano 2, and the sound waves, which express the piano tone, are propagated to the microphone 4. The sound waves are converted to the audio signal by means of the microphone 4, and the audio signal is transferred through the connection cable 4*a* to the signal interface 13.

The audio signal is sampled at regular intervals, which is much shorter than the inverse Hz' of target frequency, and the fundamental frequency component is extracted from the discrete values on the audio signal. The pieces of fundamental frequency data, which express the fundamental frequency component, are accumulated in the random access memory 12. Each of the fundamental frequency components is representative of the actual frequency audio signal, and is labeled with 40*a* or 40*b* in FIG. 4.

Plural series of pieces of fundamental frequency data are extracted from the accumulated pieces of fundamental frequency data 40*a* or 40*b*. The delay time, which is equal to the inverse Hz' of target frequency, is introduced between each of the plural series of pieces of fundamental frequency data and the next series of pieces of fundamental frequency data.

The plural series of fundamental frequency data are converted to plural series of polarity data. In this instance, the positive discrete values and negative discrete values are replaced with "1" and "0", respectively. A bit string "1" expresses the positive portion of the polarity pattern, and is colored in black in FIG. 4. On the other hand, a bit string "0" expresses the negative portion of the polarity pattern, and is colored in white in FIG. 4. The single signal waveform of the fundamental frequency component 40*a*/40*b* of audio signal forms a pair of positive portion and negative portion so that the pieces of polarity data are expressed as pairs of positive and negative portions.

Since the window is two and half times longer than the inverse Hz' of target frequency, the central processing unit 10 extracts the plural series of pieces of polarity data for the windows, respectively, and the plural series of pieces of polarity data express the basic images 41*a*, 41*b*, 41*c*, 41*d*, 41*e*, . . . or 41*f*, 41*g*, 41*h*, 41*i*, . . . . The delay time, which is equal to the inverse Hz' of target frequency, is introduced between the adjacent two series of pieces of polarity data so that the basic images 41*b*, 41*c*, 41*d*, 41*e*, . . . or 41*g*, 41*h*, 41*i*, 41*j*, . . . are offset from the previous series of polarity data 41*a*, 41*b*, 41*c*, 41*d*, . . . or 41*f*, 41 *g*, 41*h*, 41*i* by the inverse Hz' of target frequency.

The fundamental frequency component of audio signal 40*a* swings the potential level at 440.00 hertz so that each signal waveform is equal in length to the inverse Hz' of target frequency. The positive portion is equal in length to half of the wavelength of the fundamental frequency component 40*a* of audio signal, and the negative portion is also equal to the other half of the wavelength of the fundamental frequency component 40*a* of audio signal. For this reason, the boundary between the positive portion and the negative portion is just aligned with the zero-cross point on the time base. Since the window is two and half times longer than the inverse Hz' of target frequency, the basic images 41*a*, 41*b*, 41*c*, 41*d*, 41*e*, . . . exactly occupy the windows, respectively. In other words, each of the basic images 41*a*, 41*b*, 41*c*, 41*d*, 41*e*, . . . is same as the other basic images 41*b*, 41*c*, 41*d*, 41*e*, . . . , 41*a*.

On the other hand, the fundamental frequency component 40*b* of audio signal has the wavelength longer than the inverse Hz' of target frequency so that each of the polarity patterns in the basic images 41*f*, 41*g*, 41*h*, 41*i*, 41*j* . . . becomes longer than the inverse Hz' of target frequency. The boundary between the positive portion and the negative portion is not aligned with the zero-cross point on the time base, and two and half polarity patterns can not occupy the single window. As a result, the ratio between the positive portion and the negative portion in each window is varied, and the boundary between the positive portion and the negative portion is moved together with time.

Figure 5A:
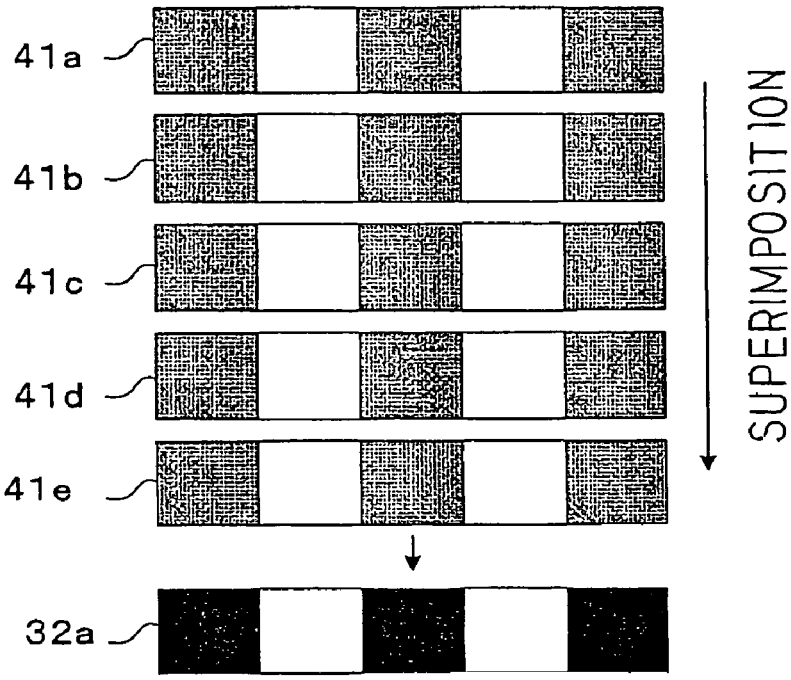
FIGS. 5A and 5B are views showing superimposition of the basic images to produce gradation images.
Figure 5B:
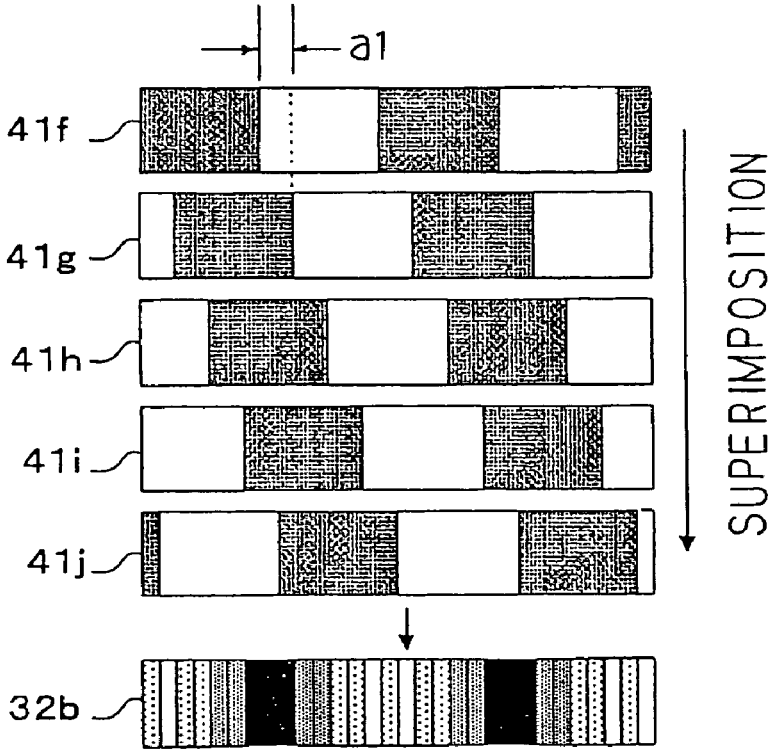

The central processing unit 10 compares the bit pattern of the series of pieces of polarity data with that of the other series of pieces of polarity data as if the images 41*a*, 41*b*, 41*c*, 41*d*, 41*e*, . . . or 41*f*, 41*g*, 41*h*, 41*i*, 41*j*, . . . are superimposed on one another as shown in FIG. 5A or FIG. 5B.

When the upright piano 2 produces the sound waves equivalent to the fundamental frequency component 40*a* of audio signal, the basic images 41*a*, 41*b*, 41*c*, 41*d*, 41*e*, . . . have the boundaries between the positive portions and the negative portions aligned with the boundaries of the other basic images 41*b*, 41*c*, 41*d*, 41*e*, . . . , 41*a*, and the basic images 41*a*, 41*b*, 41*c*, 41*d* and 41*e* are formed into the gradation image 32*a* as shown in FIG. 5A. Although the graphic controller 14 repeatedly produces the gradation image 32*a* in the area 32*a* at the renewal timing under the control of the central processing unit 10, the gradation image 32*a* is same as that in the previous cycle times. Thus, the portable tuning device informs the user that the upright piano 2 has been correctly tuned at the key number 49.

On the other hand, if the upright piano 2 produces the sound waves equivalent to the fundamental frequency component 40*b* of audio signal, the fundamental frequency component 40*b* of audio signal has the signal period longer than the inverse Hz' of target frequency, and, accordingly, the polarity pattern for the fundamental frequency component 40*b* of audio signal becomes longer than that for the fundamental frequency component 40*a* of audio signal. The window is also two and half times longer than the inverse Hz' of target frequency is. As a result, two-odd polarity patterns occupy the window. The delay time is also introduced between the basic images 41*f*, 41*g*, 41*h*, 41*i*, 41*j*, . . . and the next basic images 41*g*, 41*h*, 41*i*, 41*j*, . . . . When the basic images 41*f*, 41*g*, 41*h*, 41*i*, 41*j*, . . . are superimposed on one another as shown in FIG. 6B, the boundaries between the positive portions and the negative portions in the basic images 41*g*, 41*h*, 41*i*, 41*j*, . . . are offset from the boundaries between the positive portions and the negative portions in the basic images 41*f*, 41*g*, 41*h*, 41*i*, 41*j*, . . . by an extremely short time a1. As a result, the basic images 41*f*, 41*g*, 41*h*, 41*i* and 41*j* are formed into the gradation image 32*b*. The gradation image 32*b* is constituted by more than two tones, and is different from the gradation image 32*a*, which expresses the tone at the target pitch.

When the gradation image 32*b* is renewed, the basic images 41*f*, 41*g*, 41*h*, 41*i*, 41*j* are changed to different basic images 41*k*, . . . . Comparing the basic image 41*f* with the basic image 41*k*, it is understood that the boundaries between the positive portions and the negative portions are moved from the basic image 41*f* to the basic image 41*k*. For this reason, the user feels the gradation image 32*b* sidewardly moved in the area 31. While the graphic controller 14 is repeatedly producing the gradation image 32*b*, the user understands the difference from the target pitch through the movement of the gradation image 32*b*.

If the cycle time is equal to one of the common multiples between the signal period of the fundamental frequency component 40*b* of audio signal and the inverse Hz' of target frequency, the gradation images, which represent the difference from the target pitch, do not sidewardly flow in the area 31. However, more than two tones form the gradation images, which represent the difference from the target pitch. As a result, the user recognizes the difference from the target pitch. Thus, the user can determine whether the upright piano 2 has been tuned at the target pitches on the basis of the number of tones in the gradation images 32*a* and 32*b*.

Figure 6:
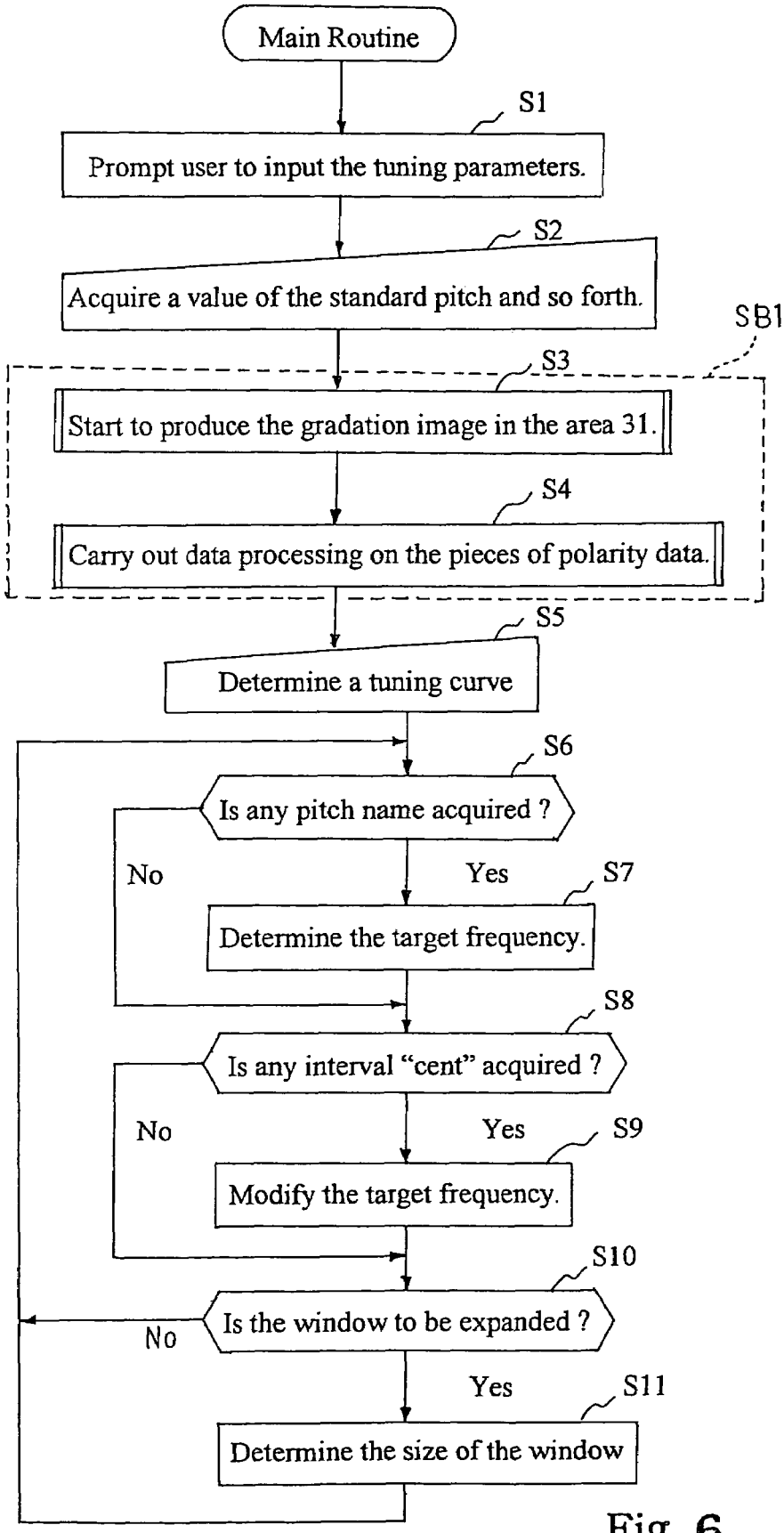
FIG. 6 is a flowchart showing a job sequence in a main routine program.
Figure 7:
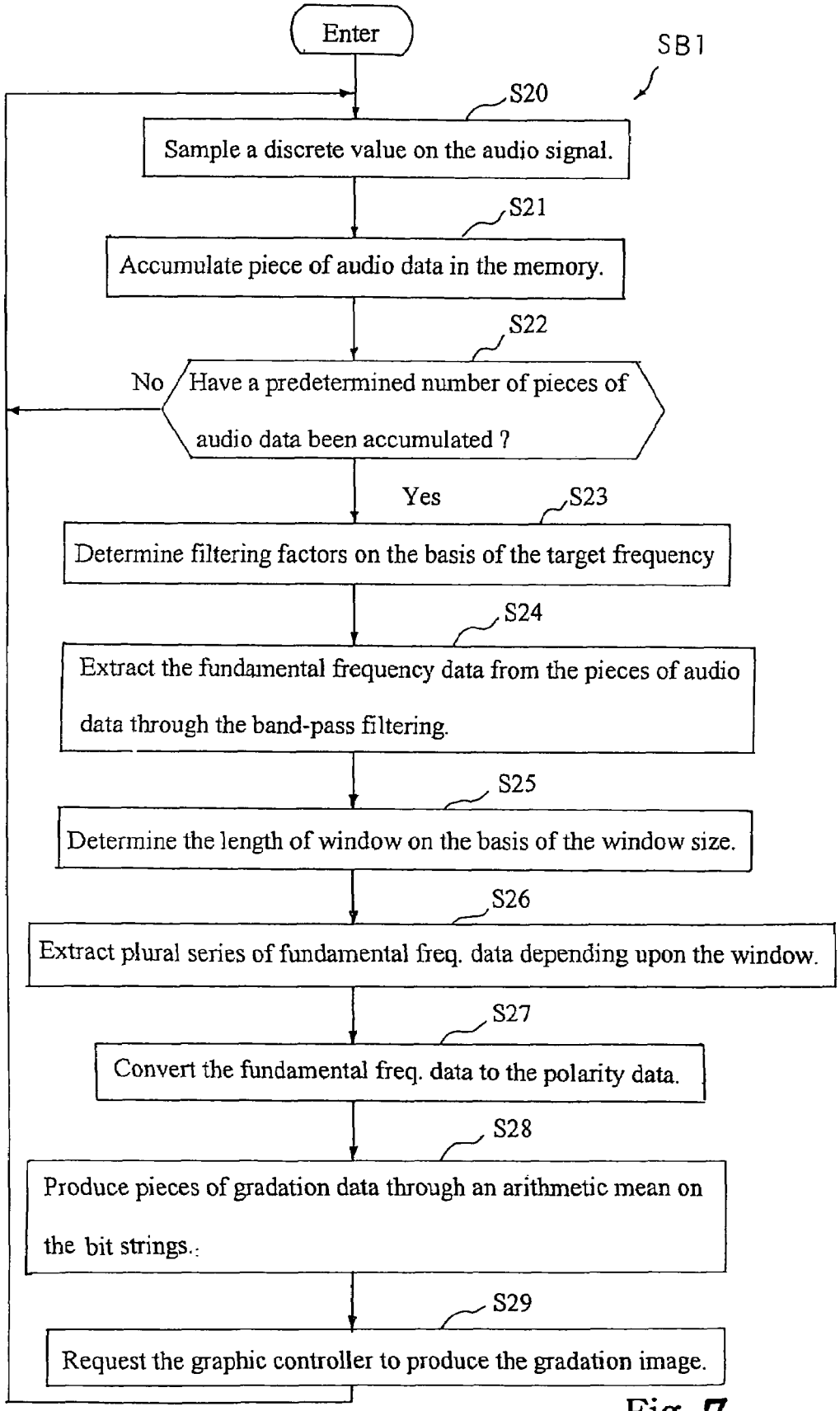
FIG. 7 is a flowchart showing a job sequence in a subroutine program for visualizing phase difference.

The above-described tuning work is realized through execution on the computer program. The computer program is broken down into the main routine program and sub-routine programs as described hereinbefore. While the main routine program is running on the central processing unit 10, the portable tuning device 1 communicates with a user for jobs to be carried out, and adjusts itself to the conditions given by the user. FIG. 6 shows a part of the main routine program relating to the tuning work on the upright piano 2. One of the subroutine programs SB1 is assigned to the visualization of phase difference, i.e., the production of the gradation images 32*a*/32*b*, and is illustrated in FIG. 7. The main routine program and subroutine program SB1 are firstly described with reference to FIGS. 6 and 7.

The main routine program periodically branches to the subroutine program SB1, and the central processing unit 10 repeatedly produces the gradation images for the cycle times. Although the subroutine program SB1 is inserted between step 2 and step 3 of the main routine program, the main routine program branches to the subroutine program SB1 at every timer interruption regardless of the job in the main routine program.

A user is assumed to turn on the power switch of the portable tuning device 1. The central processing unit 10 initializes the data processing system 1*b*, and communicates with the user for tuning parameters. One of the tuning parameters is a value of the standard pitch. The standard pitch is a frequency at A to which all the musical instrument and singers relating to an ensemble are to be tuned. There have been proposed several values for the standard pitch such as 440 hertz, 442 hertz, 439 hertz and so forth. Other tuning parameters are the pitch name, interval in cent and a size of window "W".

Upon entry into the tuning work, the central processing unit 10 firstly requests the graphic controller 14 sequentially to produce prompt messages to the user on the touch-panel liquid crystal display device 3 as by step S1. The touch-panel controller 15 informs the central processing unit 10 of the coordinates of the areas pushed by the user, and the central processing unit 10 determines user's instruction, values and options as by step S2. First, the graphic controller 14 produces the numeral images of the candidates of the standard pitch. The user is assumed to push the area where the numeral image "440.000 hertz" is produced. Then, the central processing unit 10 decides the standard pitch to be 440.000 hertz with the assistance of the touch-panel controller 15. The central processing unit 10 further cooperates with the graphic controller 14 and touch-panel controller 15 in similar manners so as to determine the pitch name, interval in cent and size W of window. The user is assumed to input A in the fifth octave, 0 cent and the standard size, i.e., 2.5 times to the portable tuning device 1. The central processing unit 10 acknowledges that the pitch name, i.e., the target frequency Hz, interval and size W of window are 440 hertz, 0 cent and two and half, i.e., 2.5 times longer than the inverse Hz' of the target frequency Hz, respectively.

Upon completion of the jobs at steps S1 and S2, the main routine program gets ready to branch to the subroutine program SB1, and the graphic controller 14 produces the gradation image in the area 31 as by steps S3 and S4. The jobs at steps S3 and S4 are hereinlater described with reference to FIG. 7.

Subsequently, the central processing unit 10 cooperates with the graphic controller 14 and touch-panel controller 15 for a tuning curve as by step S5. The term "tuning curve" means plots indicative of relation between pitch name and target frequency, and plural tuning curves are stored in the read only memory 11 in the form of table. The plural tuning curves or tables express preferable relation between the pitch name and the target frequency for different types of piano such as, for example, the grand piano and upright piano. This is because of the fact that musicians feel tones in the higher register natural at certain values of frequency higher than the standard values of frequency in the temperament. The certain values are varied depending upon the type and model of piano. For this reason, the plural tuning curves are prepared for the piano. One of the tuning curves serves as a default tuning curve so that the default tuning curve is employed for the tuning work in so far as the user does not select another tuning curve. The graphic controller 14 produces images indicative of the plural tuning curve for different types of piano. When the user pushes an area assigned to one of the tuning curves, the touch-panel controller 15 informs the central processing unit 10 of the coordinates of the area, and the central processing unit 10 determines the tuning curve.

Subsequently, the central processing unit 10 requests the graphic controller 14 to produce a prompt message, which prompts the user to input a pitch name, and waits for a time. While the prompt message is displaying on the touch-panel liquid crystal display device 3 for the predetermined time period, the central processing unit 10 repeatedly determines whether or not the user inputs a pitch name as by step S6. When the user pushes an area of a pitch name and an area of an octave, the touch-panel controller 15 informs the central processing unit 10 of the coordinates of the areas so that the central processing unit 10 determines the target frequency Hz for the pitch name on the basis of the tuning curve as by step S7. The central processing unit 10 writes the target frequency Hz together with the pitch name in the random access memory 12.

If, on the other hand, the predetermined time period is expired without any data input, the central processing unit 10 proceeds to step S8, and determines whether or not the user inputs the interval in cent into the portable tuning device 1. In detail, the central processing unit 10 requests the graphic controller 14 to produce a prompt message, which prompts the user to input the interval in cent, and waits for the data input. When the user pushes areas of numeral images, the touch-panel controller 15 informs the central processing unit 10 of the coordinates assigned to the areas, and the central processing unit 10 determines the interval from the selected pitch name. In other words, the central processing unit 10 modifies the target frequency Hz with the interval in cent as by step S9. The central processing unit 10 rewrites the target frequency Hz already stored in the random access memory 12.

If the predetermined time is expired without any data input, the central processing unit 10 proceeds to step S10 without any modification, and determines whether or not the user changes the size W of window. The graphic controller 14 produces the prompt message, and the touch-panel controller 15 checks the touch panel to see whether the user inputs an ordinary size or a large size. When the user inputs the ordinary size W, which is two and half times longer than the inverse Hz' of the target frequency Hz, the touch-panel controller 15 informs the central processing unit 10 of the coordinates of the pushed area, and the central processing unit 10 decides the window to have the ordinary size as by step S11. The central processing unit 10 writes the size of window W in the random access memory 12. If the user does not input the size W during a predetermined time period, the central processing unit 10 keeps the default size, i.e., the ordinary size, and returns to step 6. The user is assumed to select the ordinary size.

The user may firstly tune the piano 2 to the target frequency Hz at the default size W. When the user wishes precisely to tune the piano 2 to the target frequency Hz, the user enlarges the size W. Then, the central processing unit 10 magnifies the gradation image in the area 31, and makes the user recognize delicate difference from the target frequency Hz. As a result, the user precisely tunes the piano 2 to the target pitch.

Even when the central processing unit 10 changes the length of the window at step S11, the central processing unit 10 also returns to step 6. When the user changes the pitch name, the portable tuning device carries out the tuning work on the upright piano 2 at the new pitch name through the subroutine program SB1. Thus, the central processing unit 10 reiterates the loop consisting of steps S6 to S11 until the user instructs the portable tuning device to complete the tuning work.

In this instance, the portable tuning device is implemented by a PDA (Personal Digital Assistants). Images on the touch-panel liquid crystal display are renewed at 15 to 20 hertz in the standard PDA. Accordingly, the main routine program branches to the subroutine program SB1 at intervals of 15 to 20 hertz.

The main routine program is assumed to branch the subroutine program SB1. While the microphone 4 is supplying the audio signal to the signal interface 13, the analog-to-digital converter, which is incorporated in the signal interface 13, periodically samples a discrete value on the audio signal, and the discrete value is fetched by the central processing unit 10 as by step S20. In this instance, the sampling frequency is 44.1 kilo-hertz. The central processing unit 10 transfers a piece of audio data, which expresses the discrete value, to the random access memory 12 so as to accumulate the piece of audio data in the random access memory 12 as by step S21.

The central processing unit 10 checks the random access memory 12 to see whether or not a predetermined number of pieces of audio data are found in the random access memory 12 as by step S22. In this instance, the predetermined number is fallen within the range between 1024 and 2048. While the pieces of audio data are being increased toward the predetermined number, the answer at step S22 is given negative "No", and the central processing unit 10 returns to step S20. Thus, the central processing unit 10 reiterates the loop consisting of steps S20 to S22 for increasing the pieces of audio data.

When the pieces of audio data reach the predetermined number, the answer at step S22 is changed to affirmative "Yes". With the positive answer "Yes", the central processing unit 10 determines filtering factors on the basis of the target frequency Hz as by step S23. The filtering factors define the filtering characteristics of a band-pass filter. The bandwidth and center frequency serve as the filtering factors.

Subsequently, the band-pass filtering is carried out on the pieces of audio data so that the fundamental frequency component, which is expressed by pieces of fundamental frequency data, is extracted from the pieces of audio data as by step S24. In other words, the harmonics and noise are eliminated from the pieces of audio data. The pieces of fundamental frequency data are stored in the random access memory 12.

Subsequently, the central processing unit 10 reads out the size of window W from the random access memory 12, and calculates the length of window. As described hereinbefore, the user has inputted the ordinary size, i.e., 2.5 times. The central processing unit 10 reads out the target frequency Hz and the size W from the random access memory 12. The central processing unit 10 determines the inverse Hz' of the target frequency Hz, and multiplies the inverse Hz' by 2.5. Thus, the central processing unit 10 sets the window to (Hz'× 2.5) as by step S25.

Subsequently, the central processing unit 10 extracts plural series of fundamental frequency data from the pieces of fundamental frequency data already stored in the random access memory 12 for the cycle time as by step S26. Each series of fundamental frequency data is adapted to occupy one of the windows. In other words, the length of window is equal to the product between the number of pieces of fundamental frequency data in each series and the sampling period. The time delay is introduced between the first piece of fundamental frequency data of each series and the first piece of fundamental frequency data of the next series, and is equal to the inverse Hz' of target frequency.

Subsequently, the plural series of fundamental frequency data are respectively converted to plural series of polarity data as by step S27. As described hereinbefore, if pieces of fundamental frequency data have positive numbers, the pieces of fundamental frequency data are replaced with pieces of polarity data expressing binary number "1". On the other hand, if pieces of fundamental frequency data have negative numbers, the pieces of fundamental frequency data are replaced with pieces of polarity data expressing binary number "0". As a result, bit strings are left in the random access memory 12.

Figure 8A:
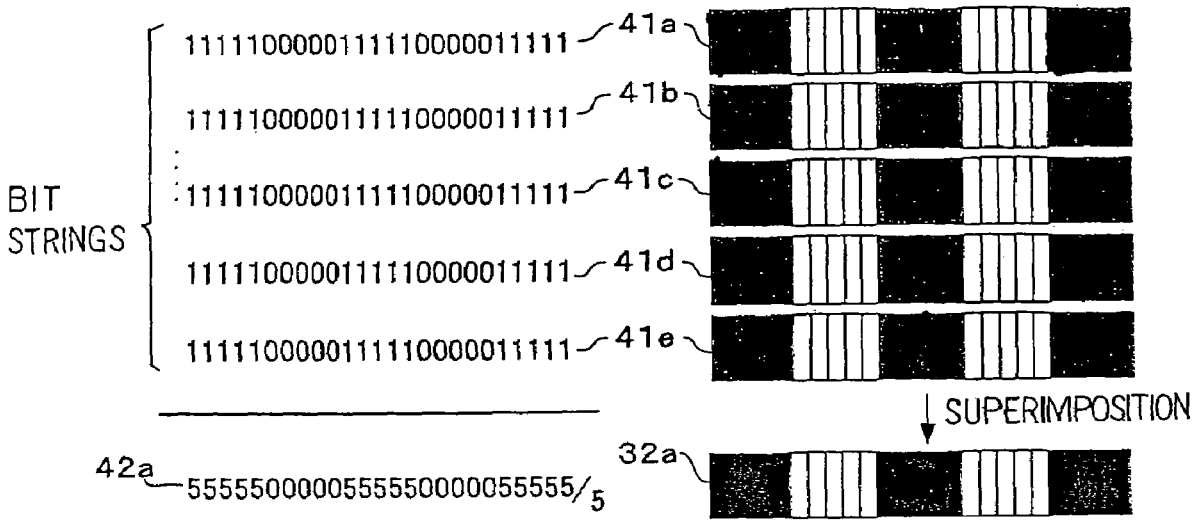
FIGS. 8A and 8*b* are views showing a superimposition of basic images.
Figure 8B:
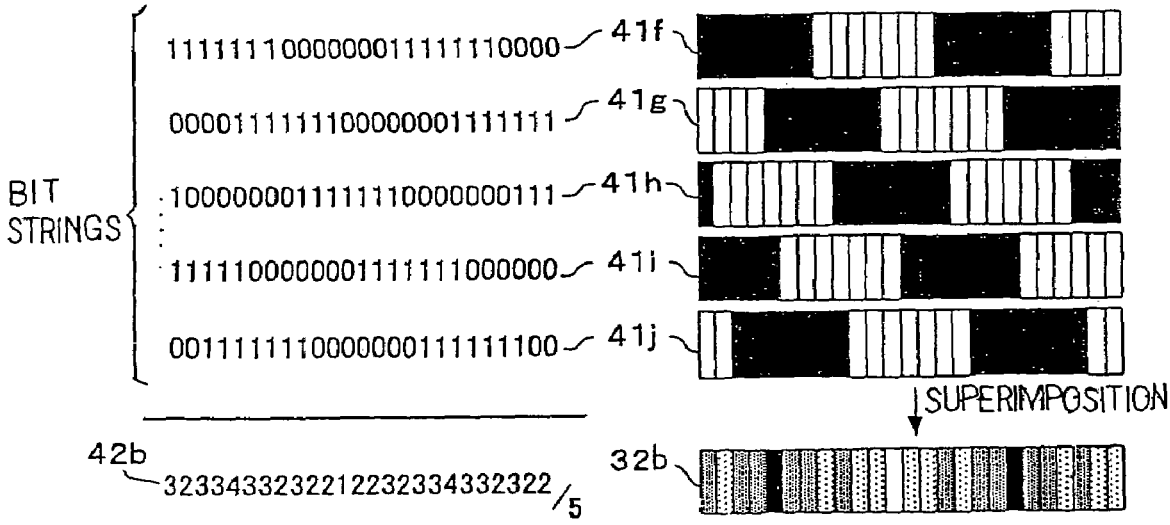

FIG. 8A shows five bit strings expressing the basic images 41*a*, 41*b*, 41*c*, 41*d* and 41*e*, and FIG. 8B shows five bit strings, which are different from those shown in FIG. 8A, and the five bit strings express the basic images 41*f*, 41*g*, 41*h*, 41*i* and 41*j*. In this instance, each series contains twenty-five pieces of polarity data, and twenty-five addresses are respectively assigned to the twenty-five pieces of polarity data. The twenty-five pieces of polarity data are respectively converted to twenty-five bits, and the twenty-five bits are written in the twenty-five memory locations respectively assigned the twenty-five addresses. Thus, the twenty-five bits form each bit string, which is corresponding to one of the basic images 41*a* to 41*j*. Since each bit has either "1" or "0", the basic images is expressed by two tones, i.e., black and white.

Subsequently, the central processing unit 10 superimposes the basic images 41*a* to 41*e* or 41*f* to 41*j* through the arithmetic mean of the bit strings. The arithmetic mean on the basic images 41*a* to 41*e* or bit strings 41*a* to 41*e* results in pieces of gradation data 42*a*, i.e., (5555500000555550000055555)/5, and the arithmetic mean on the basic images 41*f* to 41*j* results in pieces of gradation data 42*b*, i.e., (3233433232212232334332322)/5. Thus, the central processing unit 10 produces the pieces of gradation data through the arithmetic mean on the bit strings 41*a* to 41*e* or 41*f* to 41*i* as by step S28.

Finally, the central processing unit 10 supplies the pieces of gradation data 42*a* or 42*b* to the graphic controller 14, and the graphic controller 14 produces the gradation image 32*a* or 32*b* on the area 31 as by step S29. Since the fundamental frequency of audio signal 40*a* is equal to the target frequency Hz, the bit strings 41*a* to 41*e* are equal to one another, and the pieces of gradation data 42*a* is expressed by the bit string same as the bit strings 41*a* to 41*e*. Accordingly, the graphic controller 14 produces the two-tone gradation image 32*a* from the pieces of gradation data 42*a*.

On the other hand, the fundamental frequency of audio signal 40*b* is less than the target frequency Hz so that the bit strings 41*f* to 41*j* are different from one another. As a result, more than two different numbers express the pieces of gradation data 42*b*. For this reason, the graphic controller 14 produces more than two tones in the gradation image 32*b*.

Thus, the main routine program periodically branches to the subroutine program SB1, and the gradation image 32*a* or 32*b* is periodically renewed in the area 31. When the user feels the gradation image 32*a* or 32*b* vague, he or she gives the positive answer "Yes" at step S10, and inputs a different size into the portable tuning device. Then, the length of window becomes less than 2.5, and the central processing unit 10 instructs the graphic controller 14 to produce a part of the gradation image 32*b* at a large magnification ratio at step S29. The part of gradation image occupies the entire area 31. Thus, the portable tuning device 1 makes the user clearly see the difference from the target frequency Hz.

When the audio signal has the fundamental frequency 40*a* equal to the target frequency Hz, the gradation image 32*a* is repeatedly produced in the area 31 in a series of frames, and the gradations do not change the relative positions in the area 31. For this reason, the gradation image 32*a* looks as if it stops at the position in the area 31.

If the audio signal has the fundamental frequency greater than or less than the target frequency Hz, the user sees the gradation image moving in the area 31 or constituted by more than two tones. In detail, in case where the cycle time is equal to a common multiple between the inverse of the actual frequency and the inverse Hz' of target frequency, the gradation image looks as if it stops regardless of the consistency between the actual frequency and the target frequency. Nevertheless, the gradation image is still constituted by more than two tones. For this reason, the user recognizes the inconsistency by the aid of the gradation image constituted by more than two tones. When the cycle time is not equal to the common multiples, the user sees the gradation image, which is constituted by more than two tones, moving in the area. Thus, the user surely recognizes the inconsistency in so far as the fundamental frequency is different from the target frequency Hz.

The fundamental frequency is assumed to get close to the target frequency Hz. The portable tuning device slows down the gradation image, and the user feels it difficult to determine whether or not the gradation image still moves. In this situation, the user instructs the portable tuning device to expand the gradation image so that the portable tuning device 1 laterally magnifies a part of the gradation image in the area 31. Accordingly, the tones of gradation image are laterally moved faster than previous tones were. Then, the user recognizes the inconsistency between the actual frequency and the target frequency Hz, and continues the tuning work on the piano 2.

As will be understood from the foregoing description, the user accurately tunes the musical instrument to the target frequency Hz by virtue of the gradation image variable in size.

Figure 9:
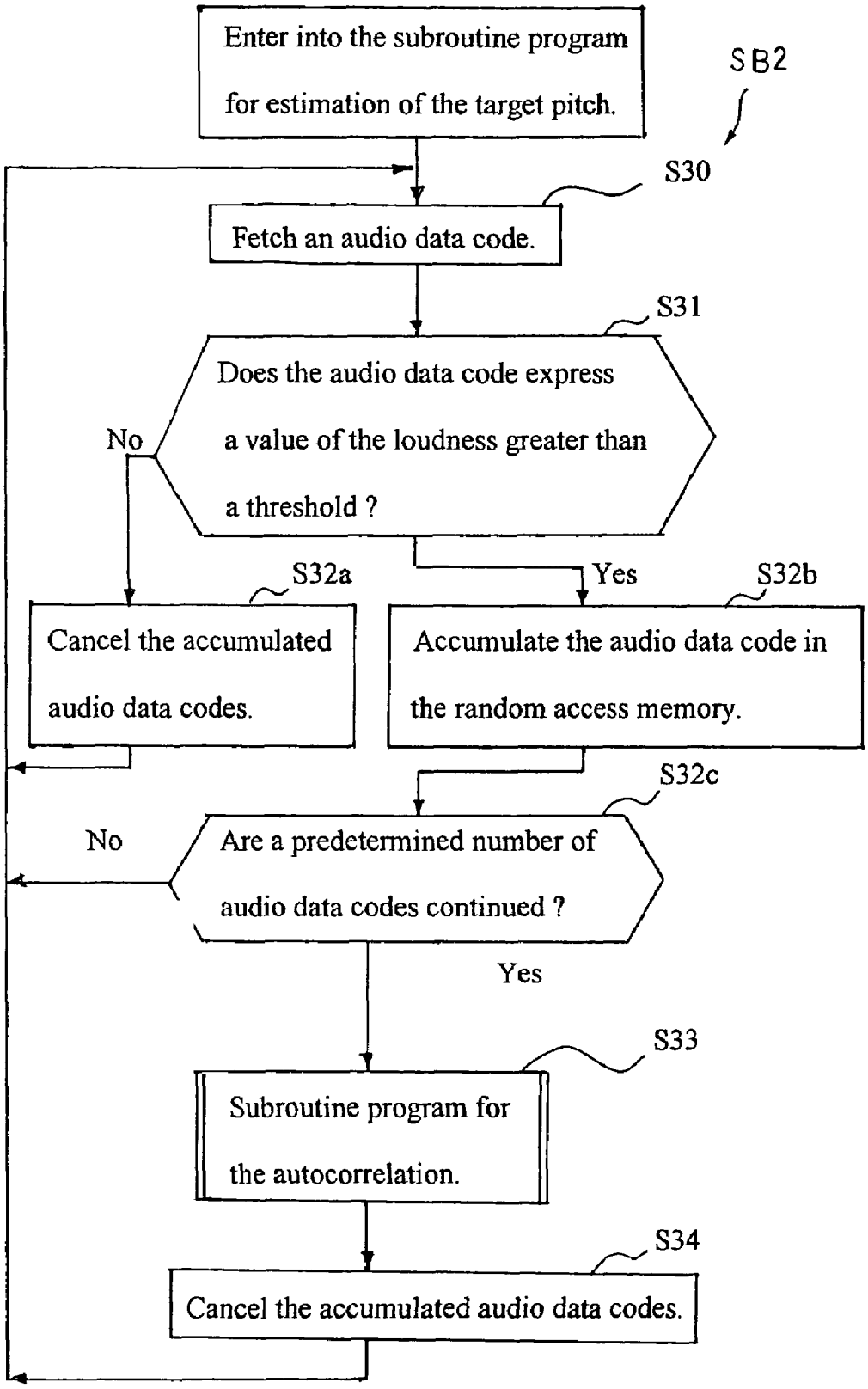
FIG. 9 is a flowchart showing a job sequence of a subroutine program for estimation of an actual pitch.

Description is hereinafter made on the subroutine program for the estimation of the actual frequency. If the user depresses a key without the positive answer "Yes" at step S6, the main routine program periodically branches to not only the subroutine program for the visualization of phase difference but also the subroutine program for the estimation of target pitch name. The subroutine program SB1 has been already described, and the description is not repeated for the sake of simplicity. The estimation of actual frequency is repeated at relatively long time intervals such as several times per second. FIG. 9 shows the subroutine program SB2 for the estimation of target pitch.

The main routine program periodically branches to the subroutine program SB2. The microphone 4 continuously supplies the analog audio signal to the signal interface 13 for the analog-to-digital conversion, and the central processing unit 10 fetches an audio data code from the signal interface 13 as by step S30. The analog audio signal is sampled at 44.1 kilohertz.

The central processing unit 10 checks the audio data code to see whether or not the sound waves have a value of loudness greater than a threshold as by step S31. If the user keeps the environment silent, the loudness is lower in value than the threshold, and the answer at step S31 is given negative "No". With the negative answer "No", the central processing unit 10 returns to step S30 through step S32*a*. The central processing unit 10 cancels the audio data codes already accumulated in the random access memory 12 at step S32*a*. Even if loud noise has been momentarily produced, the audio data codes, which express the noise, are canceled at step S32*a* so that the noise does not have any influence on the estimation. Thus, the central processing unit 10 reiterates the loop consisting of steps S30, S31 and S32*a* until change of answer at step S31.

When a tone breaks the silence, the analog audio signal swings the potential level over the threshold, and the answer at step S31 is changed to affirmative "Yes". Then, the central processing unit 10 stores the audio data code in the random access memory 12 as by step S32*b*.

Subsequently, the central processing unit 10 checks the random access memory 12 to see whether or not a predetermined number of audio data codes are continued as by step S32*c*. The predetermined number will be hereinlater described in conjunction with the autocorrelation.

If the number of audio data codes is less than the predetermined number, the answer at step S32*c* is given negative "No", and the central processing unit 10 returns to step S30. Thus, the central processing unit 10 reiterates the loop consisting of steps S30, S31, S32*a*, S32*b* to S32*c* so as to increase the number of audio data codes stored in the random access memory 12.

When the central processing unit 10 finds the predetermined number of audio data codes in the random access memory 12, the answer at step S32*c* is changed to affirmative "Yes". With the positive answer "Yes", the central processing unit 10 proceeds to the subroutine program S33 for the autocorrelation. The subroutine program S33 will be hereinafter described in detail with reference to FIG. 10. Upon completion of the jobs in the subroutine program S33, the central processing unit 10 cancels the audio data codes accumulated in the random access memory 12, and returns to step S30. Thus, the central processing unit 10 reiterates the loop consisting of steps S30 to S34 for the estimation of an actual pitch.

As well known to the persons skilled in the art, it is possible to determine the periodicity of a waveform x(k) of a signal through the autocorrelation R(m). In the autocorrelation procedure, the autocorrelation R(m) is calculated for different values of delay time m, and the maximum value of autocorrelation R(m) is found in the calculation result. The periodicity of the waveform x(k) is determined on the basis of the maximum value of the autocorrelation R(m).

In this instance, the piano keyboard is divided into two registers, i.e., a higher register and a lower register, and the portable tuning device 1 firstly presumes the register in which the tone is to be found through the autocorrelation R(m), which is hereinafter referred to as "introductory autocorrelation". Subsequently, the portable tuning device 1 carries out the autocorrelation R(m)' or R(m)", which is hereinafter referred to as "principal autocorrelation", so as to determine the actual frequency, i.e., the pitch of the tone in the register presumed through the rough autocorrelation. The waveform of the analog audio signal is expressed by the audio data codes, and is labeled with "x(k)". The audio data codes are referred to as "samples" in the description on the autocorrelations. In this instance, the keys assigned the key numbers from 1 to 44 form the lower register, and the remaining keys, i.e., the keys assigned the key numbers from 45 to 88 belong to the higher register.

Figures 11, 12A:
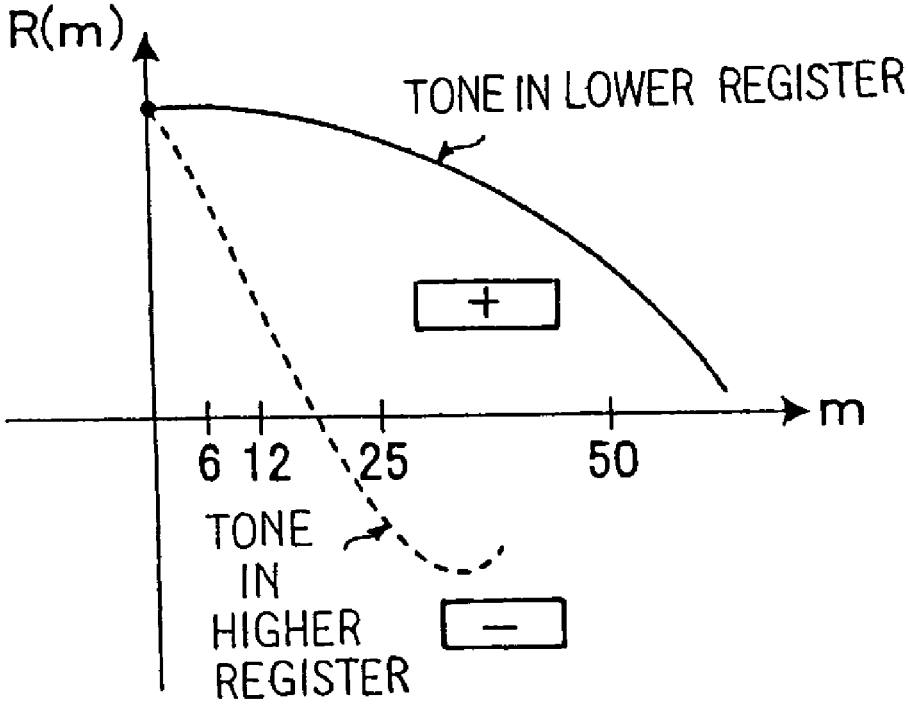
FIG. 11 is a view showing a variable used in an autocorrelation for a piano.
FIG. 12A is a graph showing relation between the variable and the autocorrelation.

In detail, when the central processing unit 10 enters the subroutine program S33, the central processing unit 10 sets a variable m for zero as by step S40*a*. The central processing unit 10 changes the variable m from the present value "zero" to the first value. The variable m expresses the delay time in millisecond, and takes one of the four values, i.e., 6, 12, 25, 50 in the introductory autocorrelation R(m) as shown in FIG. 11. Therefore, the central processing unit 10 employs 6 milliseconds as the delay time m at step S40*b*. The values of delay time m are tabled in the read only memory 11, and the table is labeled with reference numeral 50 in FIG. 2.

The predetermined number of audio data codes or samples has been already accumulated in the random access memory 12, and 500 to 1000 samples are required for the introductory autocorrelation R(m). The central processing unit 10 calculates the autocorrelation R(m) for the first value of delay time by using Equation 1 as by step S41.

$$R(m) = \sum_{k=0}^{M-m} x(k)x(k-m) \qquad \text{Equation 1}$$

where M is fallen within the range between 500 and 1000 and m is changed from 6 through 12 and 25 to 50. Equation 1 stands for operations in which products between the waveform x(k) expressed by M samples and a delayed waveform x(k−m), which is delayed from the waveform x(k) by the value of delay time m, are accumulated and the sum of products is averaged. Since the introductory autocorrelation R(m) aims at finding out general tendency, a relatively small number of samples, i.e., 500 to 1000 samples participate the calculation.

When the introductory autocorrelation R(m) is completed for the present number of delay time, the central processing unit 10 checks the table 50 to see whether or not the introductory autocorrelation R(m) has been completed for all the values as by step S42. Since the delay time was set for the first value at step 40*b*, the answer is given negative "No", and the central processing unit 10 returns to step S40*b*. The delay time m is increased to the second value "12" at step S40*b*, and the introductory autocorrelation R(m) is carried out for the second value "12". In this manner, the central processing unit 10 reiterates the loop consisting of steps S40*b* to S42 so as to calculate the introductory autocorrelation R(m) for all the values of delay time m.

When the introductory autocorrelation R(m) is calculated for the last value "50" at step S41, the answer at step S42 is changed to affirmative "Yes" so that the central processing unit 10 proceeds to step S43. The central processing unit 10 decides whether or not the introductory autocorrelation R(m) is changed from positive to negative at step S43. As shown in FIG. 12A, although a tone in the lower register makes the introductory autocorrelation R(m) keep the value positive, a tone in the higher register causes the introductory correlation R(m) to change the value from positive to negative. Therefore, the relation between the introductory correlation R(m) and the delay time makes it possible to give the answer at step S43.

When the tone belongs to the higher register, the answer at step S43 is given affirmative "Yes", and the central processing unit 10 estimates the actual frequency of the tone through the principal autocorrelation R(m)' on the waveform x(i) as by step S44. On the other hand, if the tone belongs to the lower register, the answer at step S43 is given negative "No", and the central processing unit 10 estimates the actual frequency of the tone through the principal autocorrelation R(m)" on the waveform x(j) as by step S45.

The principal autocorrelation R(m)' is expressed by Equation 2.

$$R(m)' = \sum_{j=0}^{M1-m} x(j)x(j-m) \qquad \text{Equation 2}$$

where M1 is 512 and m is delay time selected from the group of 10.54, 11.16, 11.83, . . . 112.5. 119.2 and 126.3. The number M1 of samples is small, because the wavelength of tones in the higher register is relatively short. As described hereinbefore, the keys assigned the key number from 45 to 88 belong to the higher register, and the pitch names are from F in the fourth octave to C in the eighth octave. The values of variable m are equal to the inverse of the fundamental frequency of all the tones in the higher register so that the variable m takes one of the forty-four values. The values of variable m, i.e., 10.54, 11.16, 11.83, . . . 112.5, 119.2 and 126.3 are determined on the condition that the standard pitch and sampling rate are 440 hertz and 44.1 kilohertz. Therefore, the variable m is expressed as (1/fundamental frequency of tone)×44.1 k. "k" means 1000. Thus, the principal autocorrelation R(m)' is calculated for all the values of delay time m by using Equation 2. The calculation results are stored in the random access memory 12.

On the other hand, the principal autocorrelation R(m)" is expressed by Equation 3.

$$R(m)'' = \sum_{j=0}^{M2-m/2} x(j)x(j-m) \qquad \text{Equation 3}$$

where M2 is 2048 and m is delay time selected from the group consisting of 133.8, 141.7, 150.2, . . . 1428, 1513 and 1603. Since the calculation is repeated from 0 to (M2−m/2), the number of the samples on the waveform x(j) is reduced. The delay time m takes the value equal to the inverse of the fundamental frequency of each tone in the lower register. As described hereinbefore, the key assigned the key number 1 to key assigned the key number 44 belong to the lower register so that the pitch name is varied from A in zero octave to E in the fourth octave. Accordingly, the delay time m or inverse is varied from 133.8 through 141.7, 150.2, . . . , 1428 and 1513 to 1604 on the condition same as that described in conjunction with the higher register. Thus, the principal autocorrelation R(m)" on 2048 samples is repeated for forty-four values of the delay time m. The calculation results are stored in the random access memory 12. It is possible to thin out the samples for reduce the amount of calculation.

The delay time is corresponding to the amount of offset between a series of samples and the next series of samples. Since the samples, i.e., audio data codes are sampled at the regular intervals of 44.1 kilohertz, there is a possibility not to find any sample at delayed points. In this situation, a series of samples are produced through an interpolation so as to obtain samples x(k−m) at step S41, x(i−m) at step S44 and x(j−m) at step S45.

When the calculation of the principal autocorrelation R(m)' or R(m)" is completed, the central processing unit 10 searches the random access memory 12 for the maximum value as by step S46, and determines the value of delay time m at which the principal autocorrelation R(m)' or R(m)" is maximized.

Figure 12B:
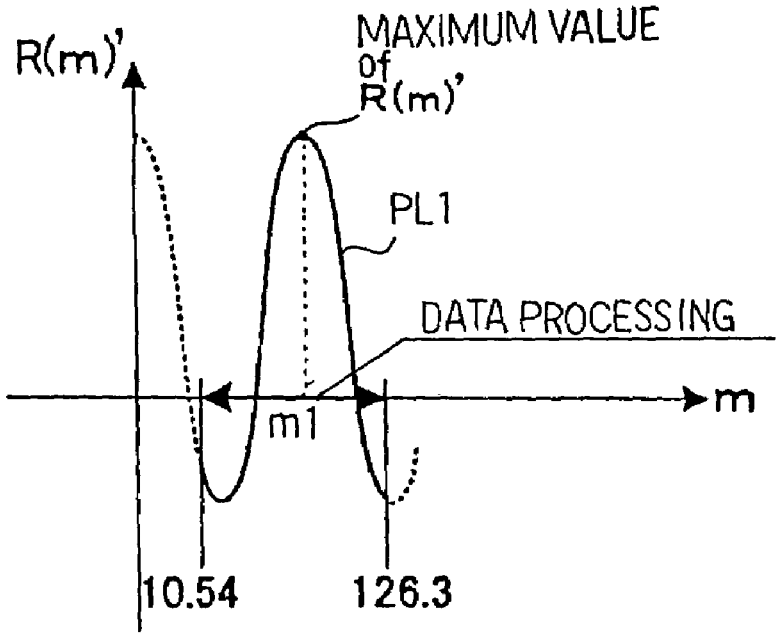
FIG. 12B is a graph showing the maximum value of the autocorrelation for a tone in a higher register.
Figure 12C:
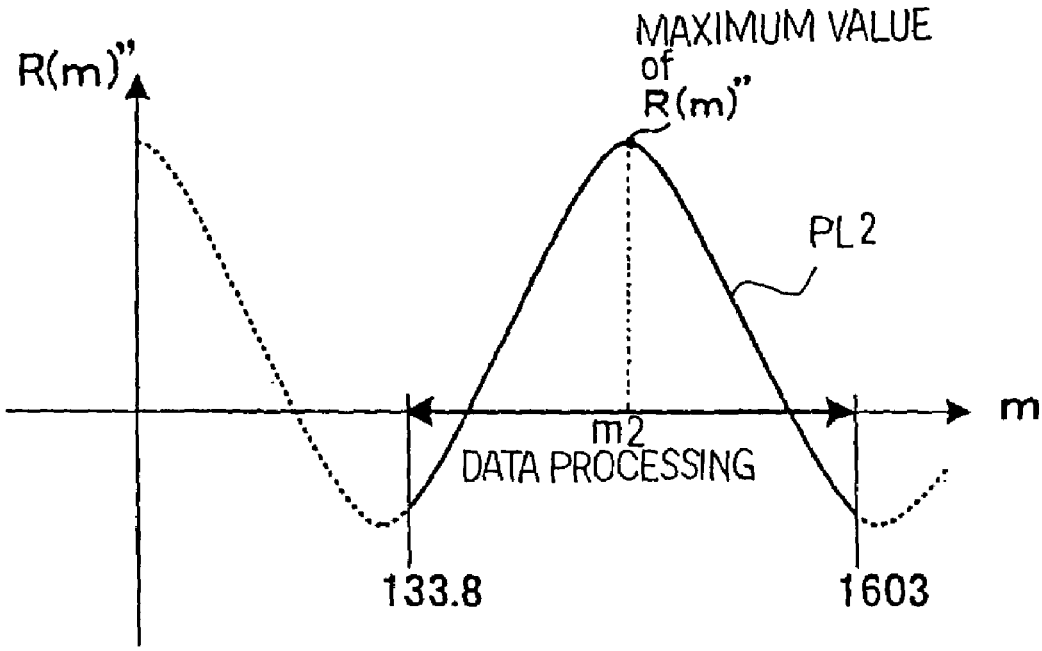
FIG. 12C is a graph showing the maximum value of the autocorrelation for a tone in a lower register.

FIG. 12B shows the principal autocorrelation R(m)' in the higher register, and FIG. 12C shows the principal autocorrelation R(m)" in the lower register. As shown in FIG. 12B, plots PL1 start to rise slightly after the delay time of 10.54 milliseconds, is maximized at a delay time m1 in the range of data processing, and is decayed toward the delay time of 126.3 milliseconds. On the other hand, plots PL2 start to rise at the delay time of 133.8 milliseconds, are maximized at a delay time m2, and are decayed toward the delay time of 1603 milliseconds. Thus, the central firstly searches the random access memory 12 for the maximum value of R(m)' or maximum value of R(m)", and determines the delay time m1 or m2 at which the principal autocorrelation R(m)' or R(m)" is maximized.

Since the delay time m1 or m2 is nearly equal to the inverse of fundamental frequency of the audio signal, the central processing unit 10 estimates the tone at a certain target frequency as by S47, and determines the pitch name as by step S48. The central processing unit 10 further accesses the table so as to determine the key number.

The central processing unit 10 requests the graphic controller 14 to produce visual images expressing the target frequency, pitch name and key number below the sub-areas assigned to the abbreviations "freq.", "oct-note" and "keyNo", respectively.

As will be appreciated from the foregoing description, one of the registers is selected from the compass through the introductory autocorrelation, and the target frequency is estimated through the principal autocorrelation. The principal autocorrelation is repeated times equal to the number of pitch names in the selected register so that the amount of calculation is drastically reduced. The selection of register makes it possible to enhance the anti-noise characteristics, because the number of candidates is preliminarily reduced. The tuning device according to the present invention exactly discriminates the pitch of a faint tone by virtue of the reduction in candidates.

Second Embodiment

Figure 13:
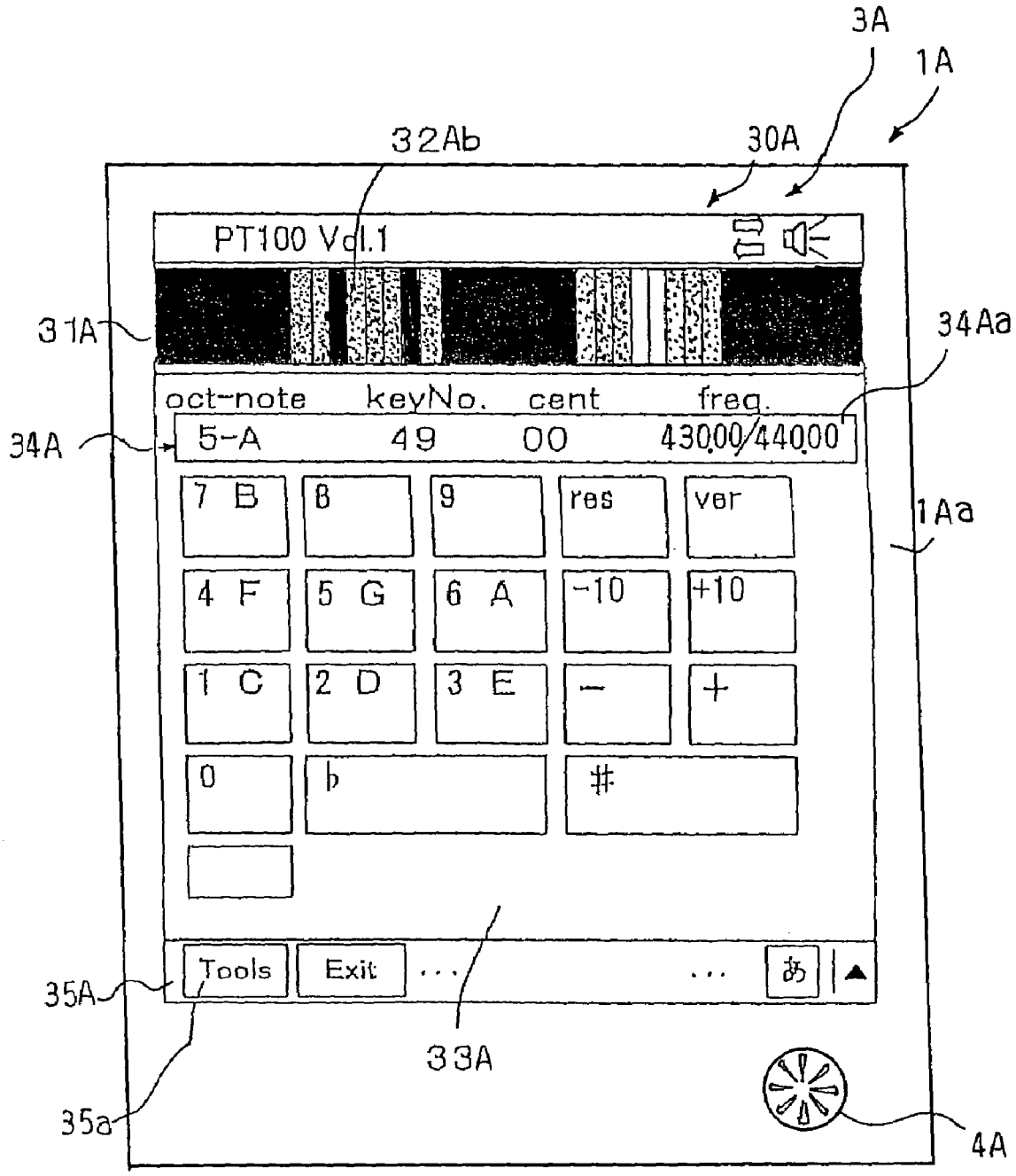
FIG. 13 is a front view showing a touch-panel liquid crystal display panel incorporated in another tuning device according to the present invention.

Turning to FIG. 13, a tuning device 1A implementing the second embodiment includes a case 1Aa, a data processing system (not shown), a touch-panel liquid crystal display device 3A and a built-in microphone 4A. The case 1Aa, data processing system (not shown) and touch-panel liquid crystal display panel 3A are similar in structure to those 1*a*, 1*b* and 3 of the first embodiment, and no further description is hereinafter incorporated for the sake of simplicity. Nevertheless, system components of the data processing system (not shown) are labeled with the same references designating the corresponding system components of the data processing system 1*b* in the following description. The built-in microphone 4A is installed inside the case 1Aa, and is exposed onto the front surface of the case 1Aa as shown.

A picture 30A is produced on the touch-panel liquid crystal display device 3A, and areas 31A, 33A, 34A and 35A are incorporated in the picture 30A. The areas 31A, 33A and 35A are assigned to the visual images to be produced in the areas 31, 33 and 35, and a gradation image 32Ab expresses the inconsistency between a target pitch and the actual pitch of a tone.

The area 34A is divided into four sub-areas labeled with "oct-note", "KeyNo", "cent" and "freq.". The abbreviations "oct-note", "KeyNo" and "cent" are same as those described in conjunction with the first embodiment, and visual images produced in these sub-areas express the pitch name and octave, key number and interval in cent as similar to those in the first embodiment. However, visual images in the sub-area 34Aa are different from that of the first embodiment. The visual images in the sub-area 34A express the actual fundamental frequency and target fundamental frequency. The visual images "430.00/440.00" mean that the actual fundamental frequency of a tone and target fundamental frequency are 430.00 hertz and 440.00 hertz, respectively. Thus, the actual fundamental frequency is visualized on the tuning device 1A together with the phase difference and target fundamental frequency.

In order to determine the actual fundamental frequency, a three-step autocorrelation is employed in the portable tuning device 1A. The main routine program and subroutine program for the visualization of phase difference are same as those illustrated in FIGS. 6 and 7, and the subroutine program SB2 is modified with step for determining an actual frequency. In other words, the subroutine program SB2 is replaced with a subroutine program SB2'.

Figure 10:
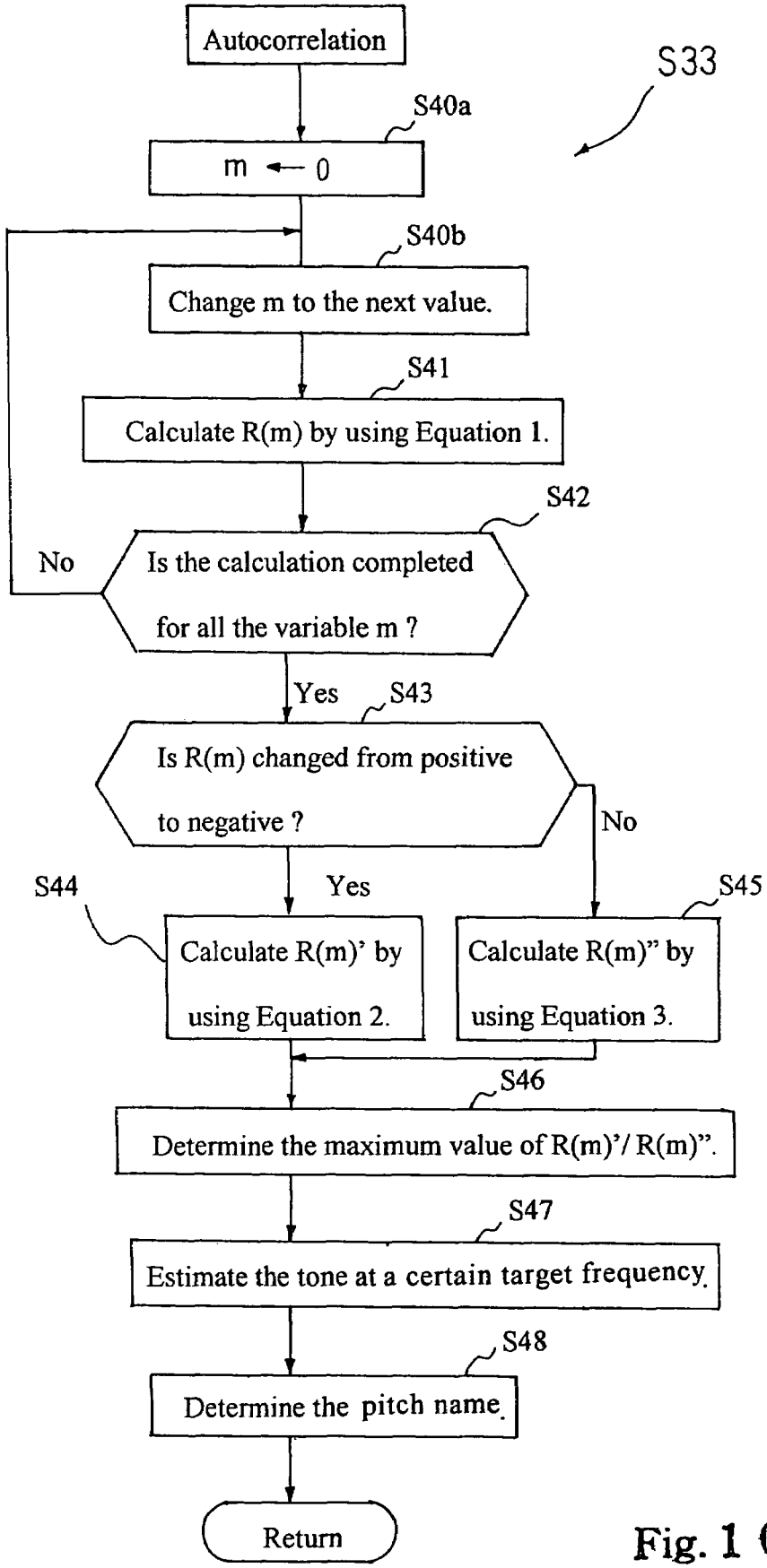
FIG. 10 is a flowchart showing a job sequence of a subroutine program for an autocorrelation.
Figure 14:
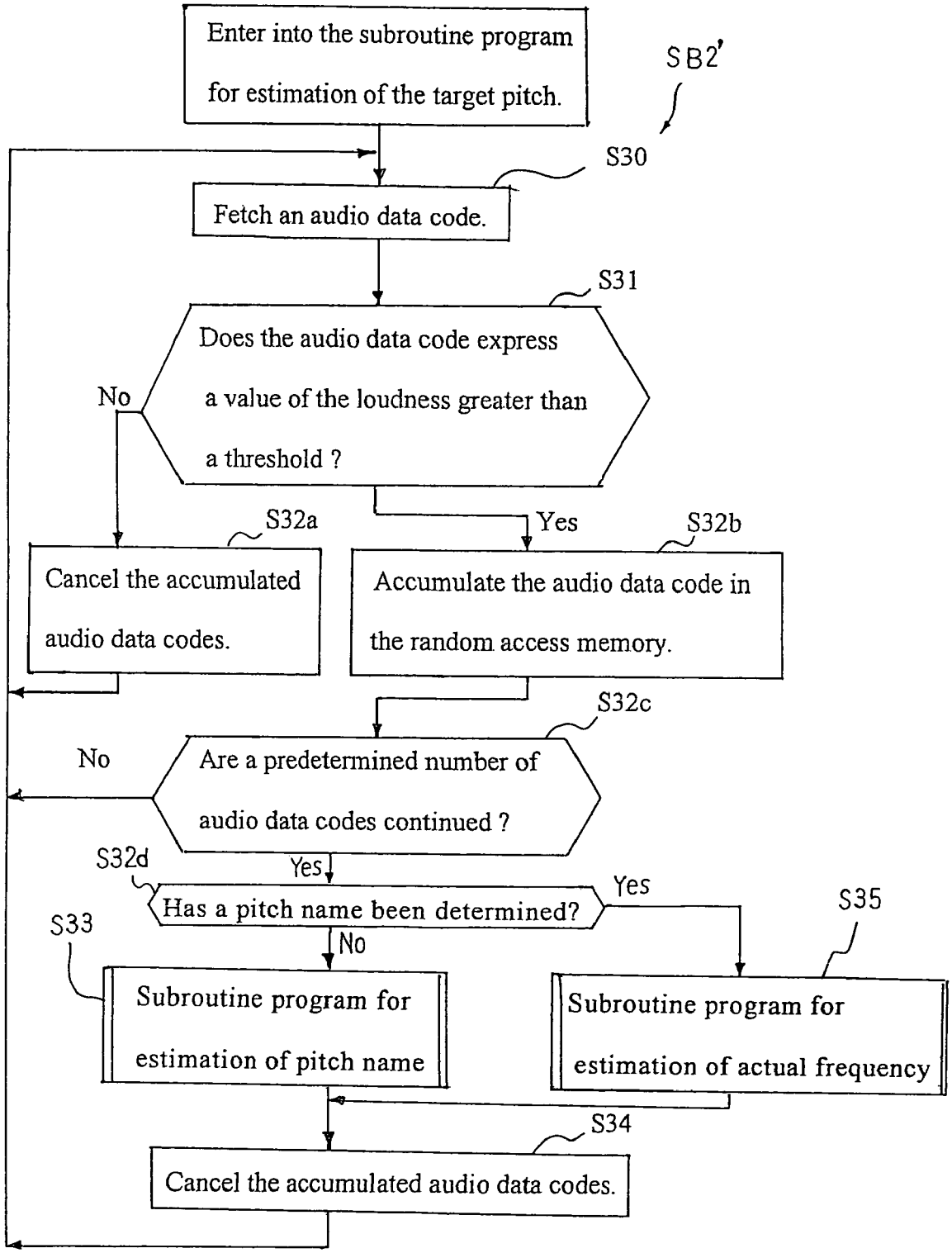
FIG. 14 is a flowchart showing a job sequence carried out in the tuning device.

Comparing FIG. 14 with FIG. 9, it is understood that steps S32*d* and S35 are introduced between steps S32*c* and S33 and between steps S32*d* and S34 in parallel to steps S33. The job sequence at step S33 is illustrated in FIG. 10. For this reason, description is hereinafter focused on steps S32*d* and S35 for the sake of simplicity.

When the predetermined number of audio data codes is accumulated in the random access memory 12, the answer at step S32*c* is given affirmative "Yes". With the positive answer, the central processing unit 10 checks the random access memory 12 to see whether or not the target pitch name has been already determined as by step S32*d*. If the answer at step S32*d* is given negative "No", the central processing unit 10 proceeds to step S33, and enters the subroutine program S33. The subroutine program S33 has been already described with reference to FIG. 10, and the description is omitted for avoiding undesirable repetition. When the central processing unit 10 estimates the tone at a certain target frequency, the central processing unit 10 determines the target pitch name, and stores a piece of data information expressing the target pitch name in the random access memory 12. For this reason, the answer at step S32*d* is changed to affirmative in the next data processing.

With the positive answer at step S32*d*, the central processing unit 10 calculates a principal autocorrelation R(m)'''. The principal autocorrelation R(m)''' is analogous to the principal autocorrelation R(m)". The delay time is varied from P0+(P0−P1)/2 to P0+(P2−P0)/2 at regular intervals of ΔP. P0 is the inverse of the fundamental frequency of the target pitch name, P1 is the inverse of the fundamental frequency at the pitch name before the target pitch name P0, and P2 is the inverse of the fundamental frequency at the pitch name next to the target pitch name P0. ΔP is the inverse of the frequency sensitive to ordinary persons. The user selects the regular intervals ΔP from the candidates stored in the read only memory 11. The range from P0+(P0−P1)/2 to P0+(P2−P0)/2 may be narrowed to a range between P0+(P0−P1)/n and P0+(P2−P0)/n where n is a natural number more than 2.

The principal autocorrelation R(m)''' is maximized at a certain delay time. The certain delay time is equal to the wavelength of the audio signal expressing the actual fundamental frequency of the tone so that the central processing unit 10 determines the actual fundamental frequency on the basis of the certain delay time.

The target frequency has been already determined at step S47, and the actual frequency is determined through the execution at step S35. For this reason, the central processing unit 10 requests the graphic controller 14 to produce the visual images in the sub-area 34Aa.

As will be understood from the foregoing description, the register, target pitch name and actual frequency are sequentially determined through the three-step autocorrelation.

Modifications of Embodiments

Although particular embodiments of the present invention have been shown and described, it will be apparent to those skilled in the art that various changes and modifications may be made without departing from the spirit and scope of the present invention.

The microphone 4 may be built in the housing 1*a*, and step 1, 2 and 5 may be arranged in an order different from that shown in FIG. 6. The audio data codes accumulated through the jobs at steps S20, S21 and S22 may be selectively used as the audio data codes to be accumulated through the jobs at steps S30, S31 and S32.

A tuning device according to the present invention may be designed for another sort of musical instrument such as, for example, the violin family. Different sorts of musical instruments usually have different compasses. Accordingly, terms "higher register" and "lower register" are varied together with the sort of musical instruments. The values of delay time m are to be found on both sides of the boundary between a range of delay time and another range of delay time, which makes a tendency of the introductory autocorrelation different from one another. In this instance, the tendency is the change in polarity of values of introductory autocorrelation. If a higher register and a lower register have a boundary different from that of the first embodiment, the two ranges of delay times are varied from those of the first embodiment, and, accordingly, the values of delay time m are different from those of the first embodiment. More than or less than 4 values are selected on both sides of the boundary. Moreover, the compass is different between a sort of musical instruments and another sort of musical instruments. In fact, a higher register of a musical instrument such as a cello form a part of a lower register of another musical instrument such as a violin. Thus, the values of delay time m, i.e., 6, 12, 25 and 50 do not set any limit to the technical scope of the present invention.

The lower register may be partially overlapped with the higher register. For example, the keys assigned with the key numbers 1 to 50 form the lower register, and the keys assigned with the key numbers 39 to 88 form the higher register. Although the amount of calculation for the principal autocorrelation R(m)'/R(m)'' is increased, the central processing unit 10 estimates the tone at a certain frequency more exactly.

The keyboard may be divided into more than two registers. The values of delay time m are to be found around each boundary between the registers for the introductory autocorrelation. Therefore, plural sets of values of delay time are required for more than two registers.

A compass of a musical instrument is, by way of example, divided into a lower register, a middle register and a higher register. Although the register to which the tone belongs is determined on the basis of the polarity at the last value m4 of delay time in the above-described embodiment, plural criteria may be employed for the three registers. The first criterion is same as that of the above-described embodiment. Another criterion is relation between the minimum value of the introductory autocorrelation R(m) and the delay time at which the introductory autocorrelation R(m) is changed to negative. Thus, there are several methods to determine the register to which the tone belongs. In order to estimate the target frequency of a tone, step S43*b* branches to steps S44/S45 and another step S49 for the middle register. In the principal autocorrelation at step S49, the inverse of the fundamental frequency of tones in the middle register serves as the delay time m.

The number M1 and number M2 are examples, and 512 and 2048 do not set any limit to the technical scope of the present invention. The number of samples M1 and M2 are determined on the basis of the sampling intervals and the longest wavelength of the tones in the register. If the longest wavelength is shorter than that of the preferred embodiment, the number M1 is less than 512.

The number of variable m at step S41 does not set any limit to the technical scope of the present invention. The introductory autocorrelation R(m) may be calculated for more than 4 values of the delay time m. Moreover, the variable may be expressed by an equation, and the central processing unit 10 determines the values of delay time m between step S40*b* and step S41.

The number of values of delay time m is determined on the condition that the standard pitch and sampling rate are 440 hertz and 44.1 kilohertz. In case of a different condition, the number of values of delay time m is different from those described in conjunction with the first embodiment.

The PDA does not set any limit to the technical scope of the present invention. The computer program of the present invention may be loaded in a personal computer system. Moreover, the method of the present invention may be realized through a wired logic circuit.

The liquid crystal display panel may be replaced with an array of light emitting diodes or another sort of display panel such as, for example, an organic electro luminescence panel.

A simple tuning device may execute a part of the main routine program and subroutine programs shown in FIGS. 9 and 10. In other words, the subroutine program for the visualization of phase difference is eliminated from the computer program installed in the simple tuning device.

The microphone does not set any limit to the technical scope of the present invention. The audio signal may be directly produced from the vibrations of strings. Such a vibration-to-electric signal converter may be a piezoelectric element.

The component parts of tuning devices 1/1A are correlated with claim languages as follows. The microphone 4/4A is corresponding to a "converter", and the upright piano 2 serves as a "musical instrument". The data processing system 1*b* and computer program, which includes the main routine program and subroutine programs SB1, SB2 and SB2', serve as a "data processing system". The introductory autocorrelation and principal autocorrelation form parts of a "multiple-step autocorrelation". The touch-panel liquid crystal display device 3/3A serves as a "man-machine interface".

The data processing system 1*b* and subroutine program SB2 as a whole constitute a "first executor", and the introductory autocorrelation expressed by Equation 1 is corresponding to an "autocorrelation". The data processing system 1*b* and subroutine program S33 as a whole constitute a "second executor", and the principal autocorrelation expressed by Equations 2 and 3 is corresponding to "another autocorrelation".

The central processing unit 10 and jobs at steps S40*a*, S40*b*, S41 and S42 serve as a "preliminary calculating routine" of the first executor, and the central processing unit 10 and jobs at step S43 serve as a "judging routine" of the first executor.

The central processing unit 10 and jobs at steps S44 and S45 serve as a "preliminary calculating routine" of the second executor, and the central processing unit 10 and jobs at steps S46 and S47 serve as a "judging routine" of the second executor.

The data processing system 1*b* and subroutine program SB1 serve as "another data processing system". The central processing unit 10 and jobs at steps S20 to S27 serve as a "basic image producer", and the central processing unit 10 and jobs at steps S28 and S29 serve as a "composite image producer". The central processing unit 10 and loop of steps S20 to S29 serve as a "time keeper".

What is claimed is:

1. A tuning device for assisting a user in a tuning work on a musical instrument, comprising:

a converter converting vibrations representative of a tone produced in said musical instrument to an electric signal representative of said vibrations;

a data processing system connected to said converter, carrying out a multiple-step autocorrelation on a waveform of said electric signal, and narrowing down a frequency range featuring said tone so as to determine a certain register within which said tone is fallen through an earlier execution of said multiple-step autocorrelation and a pitch of said tone through a later execution of said multiple-step autocorrelation; and a man-machine interface connected to said data processing system, and visualizing a result of said multiple-step autocorrelation.

2. The tuning device as set forth in claim 1, in which said data processing system includes a first executor calculating an autocorrelation so as to determine said certain register within which said tone is fallen, and second executor calculating another autocorrelation for delayed waveforms corresponding to tones in said certain register so as to determine said pitch of said tone.

3. The tuning device as set forth in claim 2, in which said first executor has a preliminary calculating routine calculating said autocorrelation for assumptive waveforms delayed from said waveform by values of delay time, said values of delay time being selected in such a manner as to cause said autocorrelation for the assumptive waveforms of the waveforms expressing tones in a register to exhibit a tendency different from that of said autocorrelation for the assumptive waveforms of the waveforms expressing tones in another register, and a judging routine examining the result of said autocorrelation to see whether or not said autocorrelation for the assumptive waveforms delayed from said waveform exhibits either tendency and determining said certain register.

4. The tuning device as set forth in claim 3, in which said values of delay time are selected in such a manner that said autocorrelation for said assumptive waveforms in said register exhibits a polarity change different from that exhibited by said autocorrelation for said assumptive waveforms in said another register.

5. The tuning device as set forth in claim 3, in which said autocorrelation R(m) is expressed by $$R(m) = \sum_{k=0}^{M-m} x(k)x(k-m)$$

where x is samples expressing said waveform, M is the number of said samples and m is said values of delay time.

6. The tuning device as set forth in claim 3, in which said judging routine determines whether the values of said autocorrelation R(m) are found in one of the positive and negative regions or are changed between said negative region and said positive region, and judges one of the registers to be said certain register.

7. The tuning device as set forth in claim 2, in which said second executor includes a preliminary calculating routine calculating said another autocorrelation for assumptive waveforms delayed from said waveform and respectively expressing the tones in said certain register, and a judging routine searching the result of said another autocorrelation for a maximum value of said another autocorrelation and determining the wavelength of said waveform expressing said tone on the basis of the delay time introduced into one of the assumptive waveforms at said maximum value.

8. The tuning device as set forth in claim 7, in which said another autocorrelation is expressed by the following equation $$R(m)' = \sum_{j=0}^{M1-m} x(j)x(j-m)$$

where x is samples expressing said waveform, M1 is the number of samples and m is a value of delay time.

9. The tuning device as set forth in claim 7, in which said another autocorrelation is expressed by one of the following equations respectively used for the tones in said register and the tones in said another register $$R(m)' = \sum_{j=0}^{M1-m} x(j)x(j-m)$$

where x is samples expressing said waveform, M1 is the number of samples and m is a value of delay time, and $$R(m)'' = \sum_{j=0}^{M2-m/2} x(j)x(j-m)$$

where x is samples expressing said waveform, M2 is the number of samples and m is a value of delay time.

10. The tuning device as set forth in claim 1, further comprising another data processing system connected to said converter and said man-machine interface, and producing a composite image expressing a phase difference between a target frequency of said tone and an actual frequency of said tone through an analysis on said waveform.

11. The tuning device as set forth in claim 10, in which said another data processing system includes a basic image producer connected to said converter, and producing plural basic images representative of a repetition period of a certain frequency component incorporated in said tone in such a manner that window time periods of said basic images are partially overlapped with one another, and a composite image producer connected to said basic image producer, superimposing said basic images in such a manner that a delay time is eliminated from between each of said window time periods and the next window time period following said each of said window time periods so as to produce said composite image, and causing said man-machine interface to visualize said composite image.

12. The tuning device as set forth in claim 11, in which said basic image producer produces each of said basic images from a series of pieces of waveform data assigned respective data positions, said composite image producer produces said composite image from a series of pieces of composite data, and each of said pieces of composite data is produced through an arithmetic mean on the pieces of waveform data each occupied at one of said data positions in one of the plural series of pieces of waveform data.

13. The tuning device as set forth in claim 11, said another data processing system further includes a time keeper connected to said basic image producer and said composite image producer and causing said basic image producer and said composite image producer to produce said basic images and said composite image at time intervals longer than each of said window time periods.

14. A computer program expressing a method for assisting a tuning work on a musical instrument, said method comprising the steps of a) converting vibrations representative of a tone produced in said musical instrument to an electric signal representative of said vibrations;

b) accumulating pieces of data information representative of a waveform of said electric signal in a data storage;

c) narrowing down a frequency range of said waveform featuring said tone through a multiple-step autocorrelation on said pieces of data information so as to determine a certain register within which said tone is fallen through an earlier execution of said multi-step autocorrelation and a pitch of said tone through a later execution of said multi-step autocorrelation; and d) visualizing a narrowed frequency range.

15. The computer program as set forth in claim 14, in which said step c) includes the sub-steps of c-1) calculating the autocorrelation on said pieces of data information so as to determine said certain register within which said tone is fallen, and c-2) calculating the autocorrelation for delayed waveforms corresponding to tones in said certain register so as to determine pitch of said tone.

16. The computer program as set forth in claim 15, in which said sub-step c-1) includes the sub-steps of c-1-1) calculating said auto correlation for assumptive waveforms delayed from said waveform by values of delay time, said values of delay time being selected in such a manner as to cause said autocorrelation for the assumptive waveforms of the waveforms expressing tones in a register to exhibit a tendency different from that of said autocorrelation for the assumptive waveforms of the waveforms expressing tones in another register, and c-1-2) examining the result of said autocorrelation to see whether or not said autocorrelation for the assumptive waveforms of said waveform expressing said tone exhibits either tendency and determining said certain register.

17. The computer program as set forth in claim 16, in which said autocorrelation R(m) is expressed by $$R(m) = \sum_{k=0}^{M-m} x(k)x(k-m)$$

where x is said pieces of data information on said waveform, M is the number of said pieces of data information and m is said values of delay time.

18. The computer program as set forth in claim 15, in which said sub-step c-2) includes the sub-steps of c-2-1) calculating said another autocorrelation for assumptive waveforms delayed from said waveform and respectively expressing tones in said certain register, and c-2-2) determining the amount of delay time introduced into one of said assumptive waveforms, said another autocorrelation of which is maximized in said sub-step c-2-2).

19. The computer program as set forth in claim 18, in which said another autocorrelation is expressed by the following equation $$R(m)' = \sum_{j=0}^{M1-m} x(j)x(j-m)$$

where x is said pieces of data information, M1 is the number of said pieces of data information and m is a value of delay time.

20. The computer program as set forth in claim 18, in which said another autocorrelation is expressed by one of the following equations respectively used for the tones in a register and the tones in another register $$R(m)' = \sum_{j=0}^{M1-m} x(j)x(j-m)$$

where x is said pieces of data information, M1 is the number of said pieces of data information and m is a value of delay time, and $$R(m)'' = \sum_{j=0}^{M2-m/2} x(j)x(j-m)$$

where x is said pieces of data information, M2 is the number of said pieces of data information and m is a value of delay time.

* * * * *